United States Patent [19]

Kuzunuki et al.

[11] Patent Number: 4,947,965

[45] Date of Patent: Aug. 14, 1990

[54] GROUP-CONTROL METHOD AND APPARATUS FOR AN ELEVATOR SYSTEM WITH PLURAL CAGES

[75] Inventors: Soshiro Kuzunuki, Katsuta; Yuzo Morita, Hitachi; Kenzi Yoneda, Katsuta; Takaaki Ueshima, Katsuta; Toshimitsu Tobita, Katsuta; Atsuya Fujino, Hitachi, all of Japan

[73] Assignee: Hitachi, Ltd., Tokyo, Japan

[21] Appl. No.: 315,918

[22] Filed: Feb. 27, 1989

[30] Foreign Application Priority Data

Feb. 3, 1988 [JP] Japan ..... 63-47471

[51] Int. Cl.[5] ..... B66B 1/18

[52] U.S. Cl. ..... 187/127; 187/128

[58] Field of Search ..... 187/124, 127, 128

[56] References Cited

U.S. PATENT DOCUMENTS

| | | | |
|---|---|---|---|
| 3,729,066 | 4/1973 | Iwasaka et al. | 187/128 |
| 3,857,465 | 12/1974 | Iwasaka et al. | 187/128 |
| 4,448,286 | 5/1984 | Kuzunuki et al. | 187/127 |
| 4,790,412 | 12/1988 | MacDonald et al. | 187/127 |

FOREIGN PATENT DOCUMENTS

| | | |
|---|---|---|
| 58-52162 | 3/1983 | Japan . |
| 58-63668 | 4/1983 | Japan . |

*Primary Examiner*—A. D. Pellinen

*Assistant Examiner*—W. E. Duncanson, Jr.

*Attorney, Agent, or Firm*—Antonelli, Terry, Stout & Kraus

[57] ABSTRACT

In a group-control for an elevator system with plural elevator cages, when a hall call is generated, evaluation values of all of group-controlled cages with respect to the generated hall call are calculated by a predetermined evaluation function, as expressed by the following formula:

$$\phi_n=(WT-k_pZ_p+k_cT_c+k_LL_L-K_zZ_Z-k_sZ_s)_n$$

$n=1, 2, \ldots, N$ wherein N denotes the total number of group-controlled elevator cages, WT, $Z_p$, $T_c$, $L_L$, and $Z_s$ represent evaluation indexes of a waiting time, an equal time-interval operation preferential zone, a riding time, a cage-load factor, a first-arriving cage preferential zone and a stop call, and $k_p$, $k_c$, $k_L$, $k_z$ and $k_s$ represent control parameters for the last five of the evaluation indexes above, respectively. The generated hall call is allotted to a cage having a minimal evaluation value calculated by the aforesaid evaluation function. The control parameters are selected and set at appropriate values in accordance with a manner of use of a building installed with the elevator system.

17 Claims, 25 Drawing Sheets a
SETTING OF FEELING TARGETS
1Ca
SETTING OF SPECIFICATION OF BUILDING & ELEVATOR
1Cb
INPUT OF ACTUAL DATA
1Cc
r
s
INFERRING OF INDIVIDUALIZING FUNCTION
1Cd
f(x)
CONVERSION OF FEELING TARGETS INTO CONTROL ONES
1Cf
DATA-BASE OF KNOWLEDGE FOR INDIVIDUALIZING FUNCTIONS
1Ce
b
1Fa
1Da
1Ef,
1Ec
1Fc

FIG. 7

MENU OF CONTROL ITEMS

| # | CONTROL ITEM | |
|---|---|---|
| 1 | WAITING TIME | ($S_1$) |
| 2 | RATE OF LONG-WAITNG | ($S_2$) |
| 3 | RIDING TIME | ($S_3$) |
| 4 | CAGE-LOAD FACTOR | ($S_4$) |
| 5 | RATE OF CHANGING A RESERVED CAGE | ($S_5$) |
| 6 | TIME OF INFORMATION OF A RESERVED CAGE | ($S_6$) |
| 7 | TRANSPORTATION CAPACITY | ($S_7$) |
| 8 | RATE OF FIRST-ARRIVING CAGES | ($S_8$) |
| 9 | NUMBER OF PASSING-BY CAGES | ($S_9$) |
| 10 | AMOUNT OF GENERAL INFORMATION | ($S_{10}$) |
| 11 | RATE OF SAVING CONSUMED ELECTRIC POWER | ($S_{11}$) |

CURSOR

FIG. 8

| FLAG※ | FEELING TARGETS | CONTROL TARGETS | INDIV. FUNCTIONS |
|---|---|---|---|
| 1 | $S_1$ | $x_1$ | $f_1(x_1)$ |
| 0 | $S_2$ | $x_2$ | $f_2(x_2)$ |
| 1 | $S_3$ | $x_3$ | $f_3(x_3)$ |
| 1 | $S_4$ | $x_4$ | $f_4(x_4)$ |
| 1 | $S_5$ | $x_5$ | $f_5(x_5)$ |
| 1 | $S_6$ | $x_6$ | $f_6(x_6)$ |
| 0 | $S_7$ | $x_7$ | $f_7(x_7)$ |
| 1 | $S_8$ | $x_8$ | $f_8(x_8)$ |
| 0 | $S_9$ | $x_9$ | $f_9(x_9)$ |
| 0 | $S_{10}$ | $x_{10}$ | $f_{10}(x_{10})$ |
| 0 | $S_{11}$ | $x_{11}$ | $f_{11}(x_{11})$ |

※ CF FIG. 7

FIG. 17a

| |
|---|
| NUMBER OF GROUP-CONTROLLED CAGES N |
| TOURING TIME $T_T$ |
| STANDARD OPERATION TIME-INTERVAL $\bar{t}$ |
| WORK TABLE $\bar{t}_W$ |
| FLOOR OF A FIRST-STARTING CAGE $f\ell_s$ |
| FLOOR NUMBER (LOOP VARIABLE) i |
| OPERATION TIME OF CAGE FROM FLOOR $f\ell_s$ TO FLOOR i $T(f\ell_s, i)$ |
| DIFFERENCE $\Delta t$ |
| FLAG FLG |

FIG. 17b

| |
|---|
| PREDICTIVE WAITING TIME WT |
| EQUAL-INTERVAL PREFERENTIAL ZONE $Z_P$ |
| RIDING TIME $T_C$ |
| CAGE-LOAD FACTOR $L_L$ |
| FIRST-ARRIVING CAGE PREFERENTIAL ZONE $Z_Z$ |
| STOP-CALL PREFERENTIAL ZONE $Z_S$ |

TRAFFIC DEMAND PATTERN

FIG. 32a

| | | PRIORITY | | | |
|---|---|---|---|---|---|
| | | $Q_{k_i x_1} \cdot g_1$ | $Q_{k_i x_4} \cdot g_4$ | $Q_{k_i x_8} \cdot g_8$ | $\Sigma$ |
| PARAMETER | $K_P$ | +30 | -2 | -1 | 33 |
| | $K_L$ | +12 | -9 | 0 | 21 |
| | $K_Z$ | + 6 | 0 | -2 | 8 |
| | $\Sigma$ | 48 | 11 | 3 | 62 |

CASE 1 : $g_1 = 0.6$ , $g_4 = 0.3$ , $g_8 = 0.1$

FIG. 32b

| | | PRIORITY | | | |
|---|---|---|---|---|---|
| | | $Q_{k_i x_1} \cdot g_1$ | $Q_{k_i x_4} \cdot g_4$ | $Q_{k_i x_8} \cdot g_8$ | $\Sigma$ |
| PARAMETER | $K_P$ | +10 | -3 | 0 | 13 |
| | $K_L$ | + 4 | -18 | 0 | 22 |
| | $K_Z$ | + 2 | 0 | -2 | 4 |
| | $\Sigma$ | 16 | 21 | 2 | 39 |

CASE 2 : $g_1 = 0.3$ , $g_4 = 0.6$ , $g_8 = 0.1$

GROUP-CONTROL METHOD AND APPARATUS FOR AN ELEVATOR SYSTEM WITH PLURAL CAGES

BACKGROUND OF THE INVENTION

1. Field of the invention

The present invention relates to a group-control method and apparatus for an elevator system with plural elevator cages, which is capable of providing the improved service for users.

2. Description of the related art

In the conventional group-control in an elevator system with plural elevator cages capable of serving plural floors of a building, for the purpose of raising the operation efficiency of an elevator system and improving the service for users, there has been used such a control method that the generation of hall calls is monitored on the on-line basis and a hall call generated at a certain floor is allotted to an adaptive cage, which is evaluated as a cage most suited for serving the certain floor, by taking account of the overall service condition to then occurring hall calls, whereby a waiting time of persons, who wait the arrival of an available cage in an elevator hall of the floor, can be shortened on a average.

According thereto, when a hall call is generated in a certain floor, it is evaluated which one of the plural cages is most suitable to serve the hall call generated, and the service to the hall call is assigned to a cage evaluated as the most suitable one. The aforesaid evaluation is carried out by calculating evaluation values of group-controlled cages with respect to the hall call generated in accordance with a predetermined evaluation function. A cage, which has a most desired one, e.g., maximum or minimum, of the calculated evaluation values, is selected as an adaptive one to serve the hall call.

The aforesaid evaluation function includes evaluation indexes of some kinds of control items as components to be considered. Such evaluation indexes are incorporated in the evaluation function with respective variable parameters, which can be altered in accordance with a traffic demand for the elevator system. The values of the parameters, which can satisfy desired targets of the control items under a certain traffic demand, are provided for every traffic demand in advance by the simulation carried out on the off-line basis or by the learning during the daily service operation.

In the daily service operation, the values of the parameters are at first selected in response to the traffic demand at that time. Since the traffic demand is provided as various patterns every time zone in a day, for example, the parameter can be changed- accordingly. Upon allotment of a hall call generated during the actual service operation, the aforesaid evaluation is carried out in accordance with the evaluation function with the selected values of the parameters. The hall call generated is allotted to an adaptive cage on the basis of the evaluation result.

For example, the laid-open Japanese patent application No. JP-A-58/52162 (1983) or 58/63668 (1983) discloses an elevator control apparatus of this kind. According thereto, the evaluation function includes an evaluation index of a stop call as well as that of a waiting time. The stop call means a call generated in a cage or a hall call already allotted to any one of the plural cages. In every cage, therefore, any cage surely stops at a floor corresponding to the stop call, i.e., a floor designated by the cage call as a destination floor or a floor, at which the hall call is generated.

With the evaluation function of the aforesaid prior art, a hall call generated becomes easily to be allotted to a cage having a stop call. As a result, the number of times of start and stop of the cages can be reduced as a whole, whereby the energy consumption is much improved, because it greatly depends on the start and stop of the cages.

The evaluation index of the stop call is incorporated in the evaluation function with a variable parameter functioning as a weight coefficient. If, therefore, the variable parameter of the stop call is adjusted, the degree of influence of the evaluation indexes of the waiting time and the stop call on the evaluation function changes relatively. This means that the service for users and the energy saving can be controlled appropriately by adjusting the variable parameter of the stop call.

However, the prior art described above scarcely took account of the point of view of an operation interval between elevator cages, whether it is a time-interval or a distance-interval. Accordingly, such an operational condition that a string of cages synchronously travel in the same traveling direction was likely to occur (this operational condition will be called a string-of-cages operation, hereinafter). The prior art was resultantly not sufficient to further improve the waiting time on an average, either.

SUMMARY OF THE INVENTION

It is an object of the present invention to provide a group-control method and apparatus for a elevator system with plural cages, which can adaptively control the service operation of the cages, taking account of an operation interval as one control item and other various control items, as well as a waiting time.

A feature of the present invention resides in a group-control method for an elevator system, in which, when a hall call is generated, evaluation values of all of group-controlled cages with respect to the generated hall call are calculated by a predetermined evaluation function, which includes evaluation indexes of at least two control items of a waiting time and such a first floor zone established for a cage in accordance with a position of the cage that a hall call generated within the zone is to be preferentially allotted to the cage.

Further, another feature of the present invention resides in a group-control apparatus for an elevator system, which is provided with: a first processor, provided with an input device manipulated by an operator, for executing the processing operation for determining a group-control method and various control parameters used in the group-control method, which are most suited for a manner of use of a building installed with the elevator system; a second processor, coupled to said first processor, for executing the processing operation for a call allotment, in which evaluation values of all of group-controlled cages with respect to a generated hall call are calculated in accordance with an evaluation function defined by the group-control method and the control parameters determined by said first processor and the generated hall call is allotted to an adaptive cage, which has the most desired one among the calculated evaluation values; and third processors, provided for every elevator cage and all coupled to said second processor, for controlling the service operation of the respective elevator cages in accordance with a result of the call allotment processing by said second processor; wherein the evaluation function includes evaluation indexes for control items of a waiting time taking account of an equal interval operation of the cages, a riding time, a cage-load factor, a rate of first-arriving cages and a stop call with respective control parameters functioning as weight coefficients for the respective control items, and said first processor determines the most suitable form of the evaluation function by selecting the control parameters and their values through the input device.

According to the present invention, since consideration is given the equal interval operation of the cages by introducing the concept of the first floor zone of a cage that a hall call generated within the zone is to be preferentially allotted to the cage, the string-of-cages operation can be prevented, with the result that the average waiting time and the rate of long-waiting are much improved as a whole.

According to a feature of an embodiment, since evaluation indexes of various control items are incorporated in the evaluation function with respective control parameters functioning as weighting coefficient, it can be easily carried out to select the control items and set value of the selected control items With this, the multiple target control in the group-control for an elevator system can be realized, and therefore it becomes possible to determine the group-control method and control parameters, which are most suited for a manner of use of a building installed with the elevator system.

According to another feature of the embodiment, the targets of the control items are set in terms of the feeling of human. Therefore, the work for determining the group-control method and control parameters is easy even for an operator, who is not familiar with the management of a group-controlled elevator system.

According to still another feature of the embodiment, the set targets of the control items is simulated, and the set targets and the simulation result are displayed on a display device simultaneously, whereby the comparison between the set targets and the simulation result becomes easy and therefore the judgment of the appropriateness of the set targets is facilitated. Namely, the work of selecting the control items and setting the targets thereof can be carried out on the interactive basis.

BRIEF DESCRIPTION OF THE DRAWINGS

FIG. 7 is a drawing for explaining the operation of the functional block 1C of FIG. 6, in which there is shown an example of a menu of control items;

FIG. 8 shows an example of one of memory tables, which are provided in an appropriate storage of the processor $M_1$ and used for the processing operation of the individualizing support part shown in FIG. 5;

FIG. 17*a* and 17*b* show examples of memory tables, which are provided in the appropriate storage of the processor $M_1$ and used for the processing operation in the individualizing support part shown in FIG. 5;

FIG. 32*a* and 32*b* are tables, in which there are shown examples of priorities used in the processing operation, as shown in FIG. 30, for the determination of the control parameters.

DESCRIPTION OF THE PREFERRED EMBODIMENTS

In the following, a group-control apparatus for an elevator system with plural cages according to an embodiment of the present invention will be described with reference to the accompanying drawings.

1 Overall configuration of hardware components

Figure 1:
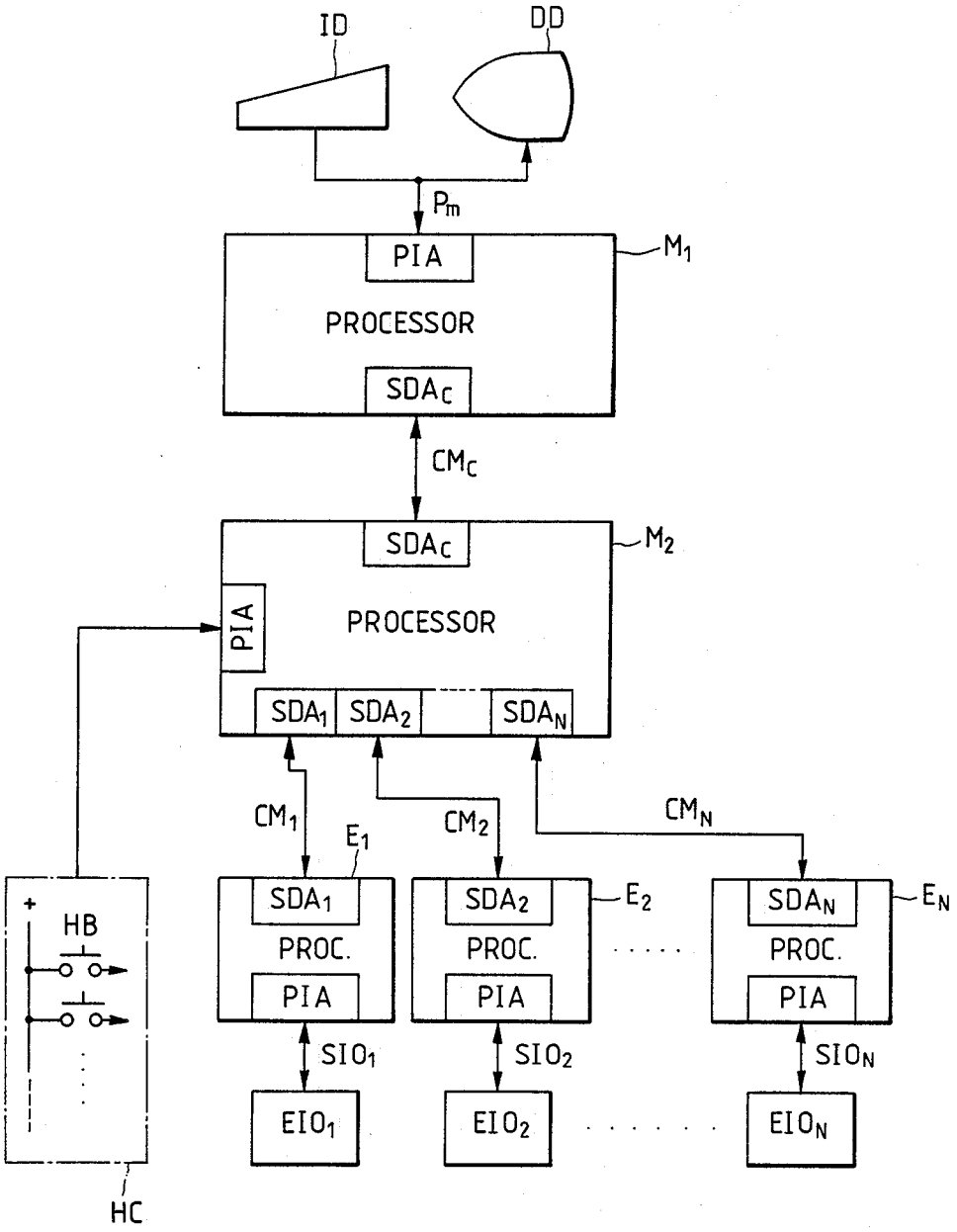
FIG. 1 is a block diagram schematically showing the overall configuration of hardware of a group-control apparatus for an elevator system with plural cages according to an embodiment of the present invention.

Referring at first to FIGS. 1 to 4, a hardware configuration will be explained. FIG. 1 shows an overall hardware configuration of an embodiments of the present invention. As shown in the fig., a group-control apparatus for an elevator system has processors $M_1$ and $M_2$ as major components, which are coupled with each other by serial data adaptors $SDA_c$ provided in the respective processors through communication line $CM_c$.

The processor $M_1$ is used for determining a group-control method, which is specific to a manner of use of an individual building (individualization of a group-control method). Input device ID, which comprises a keyboard and, if necessary, a mouse, is coupled to the processor $M_1$ by a peripheral interface adapter PIA provided therein through line $P_m$, by which instruction and data necessary for the individualization of a group-control method are given to the processor $M_1$. CRT display device DD is also coupled to the processor $M_1$, whereby an operator can achieve the individualization of a group-control method, while observing the process and result of the processing operation of the processor $M_1$.

The processor $M_2$ actually manages the operation of the plural elevator cages in accordance with the group-control method determined by the processor $M_1$ on the basis of calls generated in elevator halls of respective floors of the building or in the elevator cages. For this purpose, to the processor $M_2$, there is coupled a hall call device, which is generally denoted by reference HC, but is composed of hall button switches HB installed in the elevator halls, by a peripheral interface adaptor PIA.

The processor $M_2$ is further coupled to processors $E_1$ to $E_N$ for controlling the service operation of the respective elevator cages by serial data adaptors $SDA_1$ to $SDA_N$ provided in the respective processors through corresponding communication lines $CM_1$ to $CM_N$ (wherein suffix N denotes the total number of group-controlled elevator cages). Further, the calls generated in the cages are transmitted to the processor $M_2$ through these processors $E_1$ to $E_N$.

The operation control processors $E_1$ to $E_N$ are in turn coupled with corresponding input/output devices $EIO_1$ to $EIO_N$ by peripheral interface adaptors provided in the respective processors $E_1$ to $E_N$ through corresponding communication lines $SIO_1$ to $SIO_N$. Although details will be described later, each of the input/output devices $EIO_1$ to $EIO_N$ comprises a safety limit switch, relays, lamps and other devices for supplying information necessary for the control.

Figure 2:
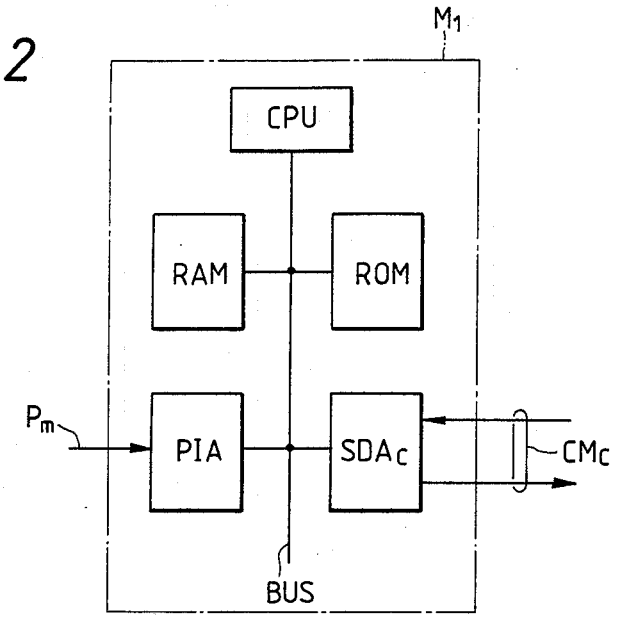
FIG. 2 is a block diagram schematically showing the configuration of a processor $M_1$ included in the apparatus of FIG. 1, which supports the work for individualizing a control method and parameters for the group-control.
Figure 4:
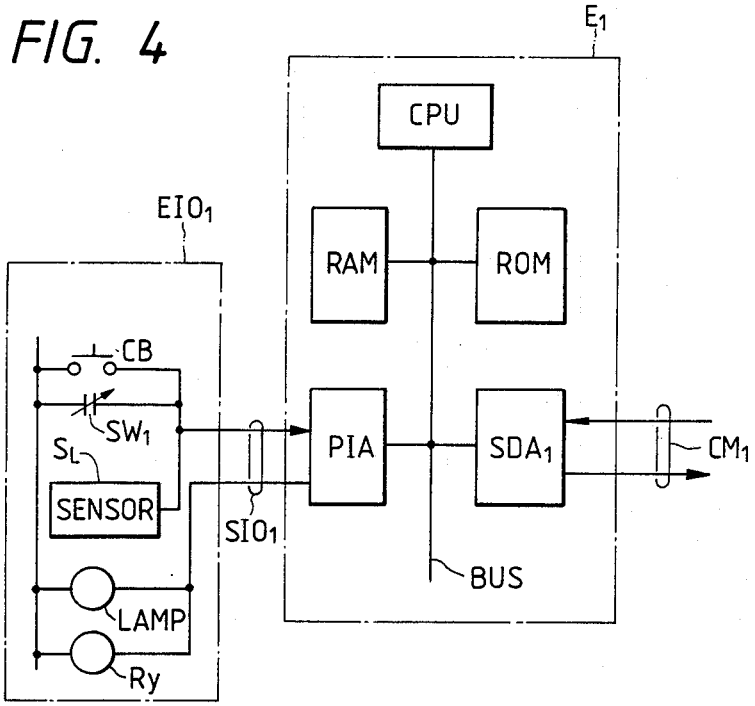
FIG. 4 is a block diagram schematically showing the configuration of one $E_1$ of operation control processors and one $EIO_1$ of input/output devices, both of which are included in the apparatus of FIG. 1.
Figure 3:
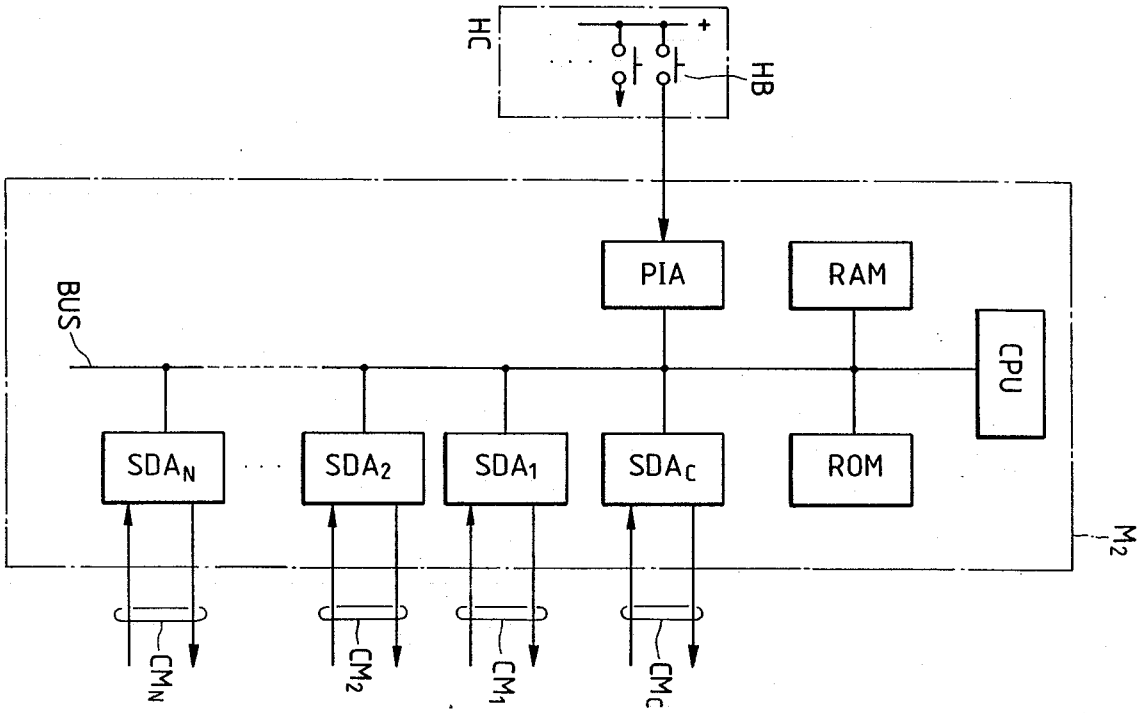
FIG. 3 is a block diagram schematically showing the configuration of a processor $M_2$ included in the apparatus of FIG. 1, which executes the group-control of the elevator system.

Referring next to FIGS. 2 to 4, further detailed configuration of the respective processors $M_1$, $M_2$ and $E_1$ to $E_N$ will be explained. FIG. 4, however, includes the configuration of only the processor $E_1$ typically.

As shown in those figs., each processor is basically composed of central processing unit CPU, read only memory ROM for storing necessary control programs and an elevator's specification, random access memory RAM for storing control data and work data. Especially in RAMs of the processors $M_1$ and $M_2$, there are provided particular areas, in which various tables and other kinds of data-base necessary for the processing operations to be executed by the processors $M_1$ and $M_2$ are stored. Although the format of such tables and data-base are shown in FIGS. 8, 17*a*, 17*b*, 24*a* to 24*c* and 28, details thereof will be described in the description of the respective processing operations later.

In each processor, there are further provided peripheral interface adaptor PIA and serial data adaptors SDA. The number of the serial data adaptors SDA in each processor depends on the number of processors to be coupled with the processor The components of each processor, as described above, are all coupled with each other through bus line BUS.

Usually, CPU of the processor Ml and M2 is constructed by a 16 bit processor unit, such as Hitachi HD680000, Intel I8086 or Zeilog Z-8000, because it must execute the considerably complex operation. On the other hand, CPU in the operation control processors $E_1$ to $E_N$ is sufficient to be a 8 bit processor unit, such as Hitachi HD46800D, Intel I8085 or Zeilog Z-80, because it only executes the processing for the service operation of an individual elevator cage and therefore the amount of data to be processed by those processors is relatively small.

Further, FIG. 4 shows also the configuration of the input/output device $EIO_1$, which is installed in a cage. As shown in the fig., the input/output device $EIO_1$ comprises a cage call button switch CB, a safety limit switch $SW_1$ and a cage load sensor $S_L$. Output signals of those components are supplied to the processor $E_1$ through the peripheral interface adaptor PIA. The processing result of the processor $E_1$ is given to a $lam_p$ for indication thereof and to a necessary relay $R_y$, e.g., a door control relay for initiating the operation of an cage door, by the peripheral interface adaptor PIA. The remaining processors $E_2$ to $E_N$ and input/output devices $EIO_2$ to $EIO_N$ have the same configuration as the processor $E_1$ and the input/output device $EIO_N$ as mentioned above.

2 The general description of function and operation

Among all the processors as mentioned above, the processors $E_1$ to $E_N$ carry out the control operation generally known as an elevator operation control, such as the door closing/opening control, the traveling speed control, the landing control, and so on, and hence a known operation control apparatus can be employed. In the following, therefore, the function and operation of the processors $M_1$ and $M_2$ will be explained mainly.

Figure 5:
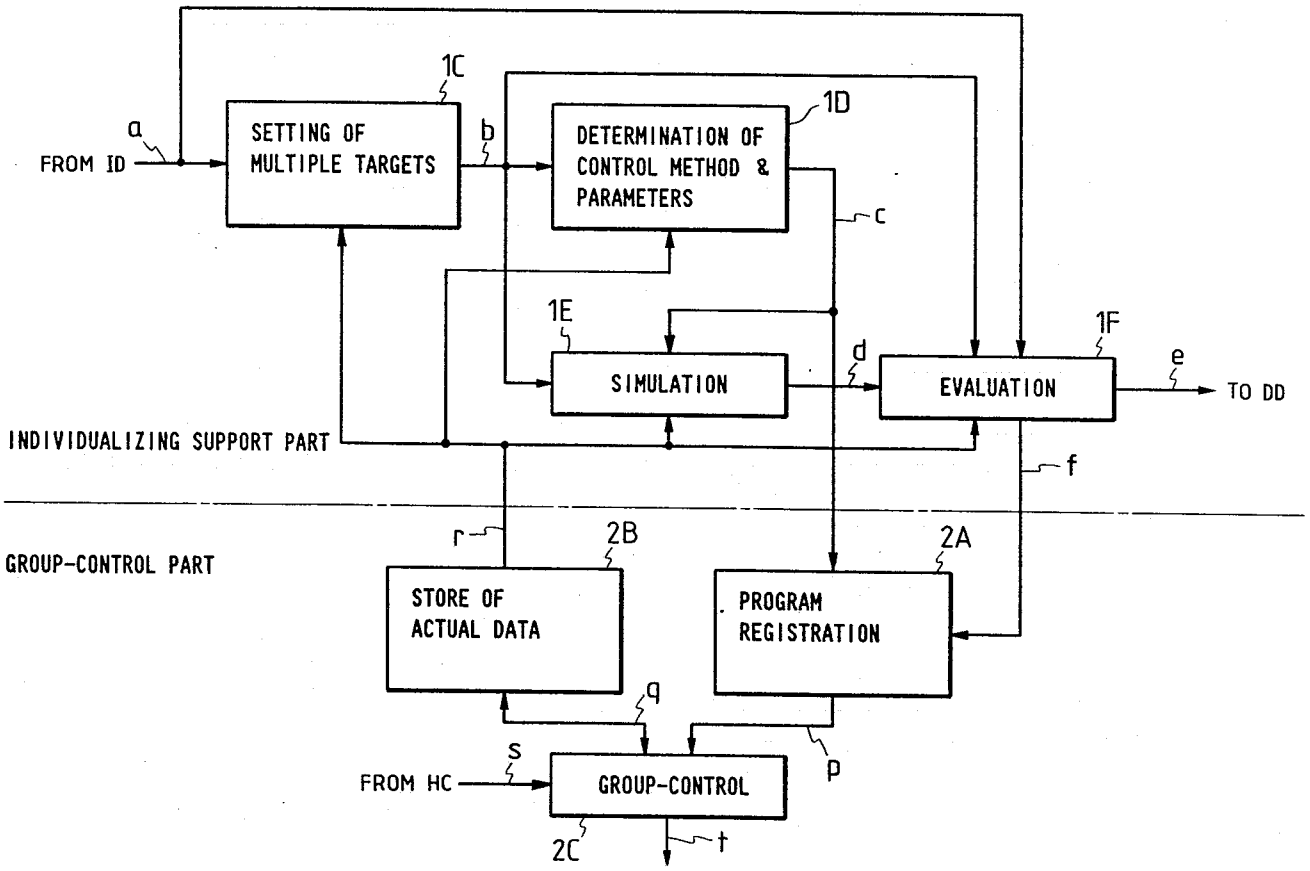
FIG. 5 is a functional block diagram showing the overall processing function or operation executed by the processors $M_1$ and $M_2$ shown in FIGS. 2 and 3, respectively.

FIG. 5 is a functional block diagram schematically showing the function and operation to be executed by the processors $M_1$ and $M_2$. The general operation shown in the figure is roughly separated into two parts, i.e., an individualizing support part carried out by the processor $M_1$ and a group-control part carried out by the processor $M_2$.

The individualizing support part has the function of supporting the work for selectively determining an elevator group-control method, including a call allotment method, in accordance with a manner of use of a building (a residential building, an office building, a department store building, etc.) or a request of a caretaker. This determination of the group-control method can be carried out on the basis of the interaction with an operator, since the determined method is simulated and the simulation result is displayed on the display device DD.

If an operator observes the displayed simulation result and, through the input device ID, gives the approval on the group-control method determined by the individualizing support part, it is transmitted to and incorporated in the group-control part to be executed by processor $M_2$.

When a hall call is generated by the hall call device HC in a certain floor, the group-control part executes the necessary processing in accordance with the group-control method incorporated therein in response to the hall call. As a result, an adaptive elevator cage, which is most suitable to serve the certain floor, is selected from among the plural cages, and the generated hall call is allotted to one of the processors $E_1$ to $E_N$, which controls the selected cage.

Although, in the foregoing, the function and operation of the respective processors $M_1$, $M_2$ and $E_1$ to $E_N$, and the relation between them have been briefly described, there will be described the general description of functional elements constructing the individualizing support part and the group-control part, before the detailed explanation of the respective parts.

2.1 Individualizing support part

As apparent from FIG. 5, this part comprises functional blocks 1C, 1D, 1E and 1F, which execute setting of targets of multiple control items, determination of a control method and parameters, simulation, and evaluation and control execution, respectively The functional block 1C carries out the selection of plural items to be controlled, such as a waiting time, a rate of long-waiting, a cage-load factor etc., and the setting of target values for the selected control items, on the basis of various information (control items, their target values, specifications of a building and an elevator) given by an operator through line a from the input device ID and actual data (traffic demand patterns) supplied through line r from the group-control part. Details of the control items will be described later. The target values for the selected control items are converted into control target values in the form suited for the successive processing.

The plural control target values set in the block 1C are coupled to the functional block 1D through line b, which block determines an adaptive method for group-controlling the operation of the elevator cages, various control parameters necessary for the group-control, etc. by the inference using the knowledge which is composed of past data provided in the form of a s called production rules. Examples of the production rules will be described in detail later.

The inference result, i.e., the determined group-control method and control parameters, of the block 1D is coupled to the functional block 1E through line c, and subject to the group-control simulation on the basis of the information given by the block 1C through the line b and the actual data supplied by the group-control part through the line r. As a result, the block 1E produces a predictive simulation result through line d.

The functional block 1F for the evaluation receives the simulation result from the block 1E, the information from the block 1C and the actual data from the group-control part, and combines them to form a display data, which is outputted to the display device DD through line e and displayed thereon. With this, an operator can observe the three kinds of information simultaneously, and therefore it becomes easy to compare the result obtained in the block 1D with the intended target values, with the result that he can easily judge whether or not the group-control method and parameters determined in the block 1D is most suited for the building.

If the operator observes the data on display and gives an approval signal thereon from the input device ID, the signal is transmitted to the block 1F through the line a. When the approval signal is applied, the block 1F transfers the signal to the group-control part. When the group-control part receives the signal, it incorporates therein the group-control method and control parameters determined in the block 1D through the line c.

If the operator is not satisfied with the result determined in the block 1D, he gives a non-approval signal, which is given to the block 1C, and the setting of the target values of the control items is repeated again. Namely, according to the present embodiment, the determination of the target values of the necessary control items is carried out by a so called interactive programing method.

2.2 Group-control part

As shown in FIG. 5, this part includes blocks 2A, 2B and 2C, which function as program registration, store of actual data and group-control, respectively.

The block 2A registers the control method, including the call allotment method, determined in the block 1D and supplied through the line c, when the approval signal is applied thereto from the block 1F. The block 2B stores traffic demand patterns, which are obtained by processing the actual data of the daily service opera ion of the elevator system. The traffic demand patterns are provided for every time zone of the service operation of the elevator system, for example.

The block 2C undertakes the main function of this part. Namely, as already described, when a hall call is generated in a certain floor, the block 2C executes the necessary processing in accordance with the group-control method registered in the block 2A, whereby an adaptive cage most suitable for serving the floor is selected and the generated call is allotted to a operation control processor for the selected cage.

3 Detailed description of the respective parts 3.1 Individualizing support part

Before the detailed description of this part, some terms concerning a call, a floor and a cage, which will be often used in the following explanation, are defined, as follows.

A call generated in an elevator hall of a floor is called "a hall call", as already described in the foregoing. A floor, at which a hall call is generated, will be called "a hall call floor". In an analogous manner, a call generated in an elevator cage will be called "a cage call" and a destination floor designated by a cage call "a cage call floor".

Further, as already mentioned, a hall call already allotted to a cage and a cage call will be called "a stop call", because a cage having such a stop call has to stop at the hall call floor or the cage call floor.

When a hall call is allotted to a cage, the cage will be called "a reserved cage", because the cage is reserved to serve the hall call. According to circumstances, however, there can be the case, where, even though a reserved cage has already been determined, another cage can arrive at a hall call floor earlier than the reserved cage. In this case, the another cage will be called "a first-arriving cage".

There is also such a case that a cage passes by a hall call floor, notwithstanding the cage can arrive at the floor earlier than a reserved cage for the floor. The cage will be called "a passing-by cage".

3.1.1 Setting of multiple targets (1C)

In the present embodiment, targets values of the control items are given by an operator in terms of the feeling of human Namely, they are not given by physical quantities, such as 25 sec. for a waiting time, 60% for a cage-load factor, etc., but by psychological quantities, which are indicated by values in several steps (five steps in the present embodiment) of an operator's feeling for the respective control items.

Such a psychological quantity will be called a feeling target or a feeling target value, hereinafter. On the other hand, a physical quantity corresponding to a feeling target will be called a control target or a control target value Although a feeling target is defined by normalizing a control target of a corresponding control item, the details of the relation between both will become apparent later. A feeling target can be said to be a kind of the qualitative concept on the elevator operation, which is derived on the basis of the sense of values, interest, taste, feeling etc., of an operator.

In this manner, in the present embodiment, target values of the necessary control items are set in terms of feeling values. Therefore, the easy manipulation is much enhanced. Further, if the setting of the feeling targets is modified in such a manner that a target of the waiting time or the cage-load factor, for example, can be inputted by plain language such as "like to use in early" or "like to use an empty cage", a further improved result can be obtained for an operator who is not well accustomed to the operation of this kind.

Figure 6:
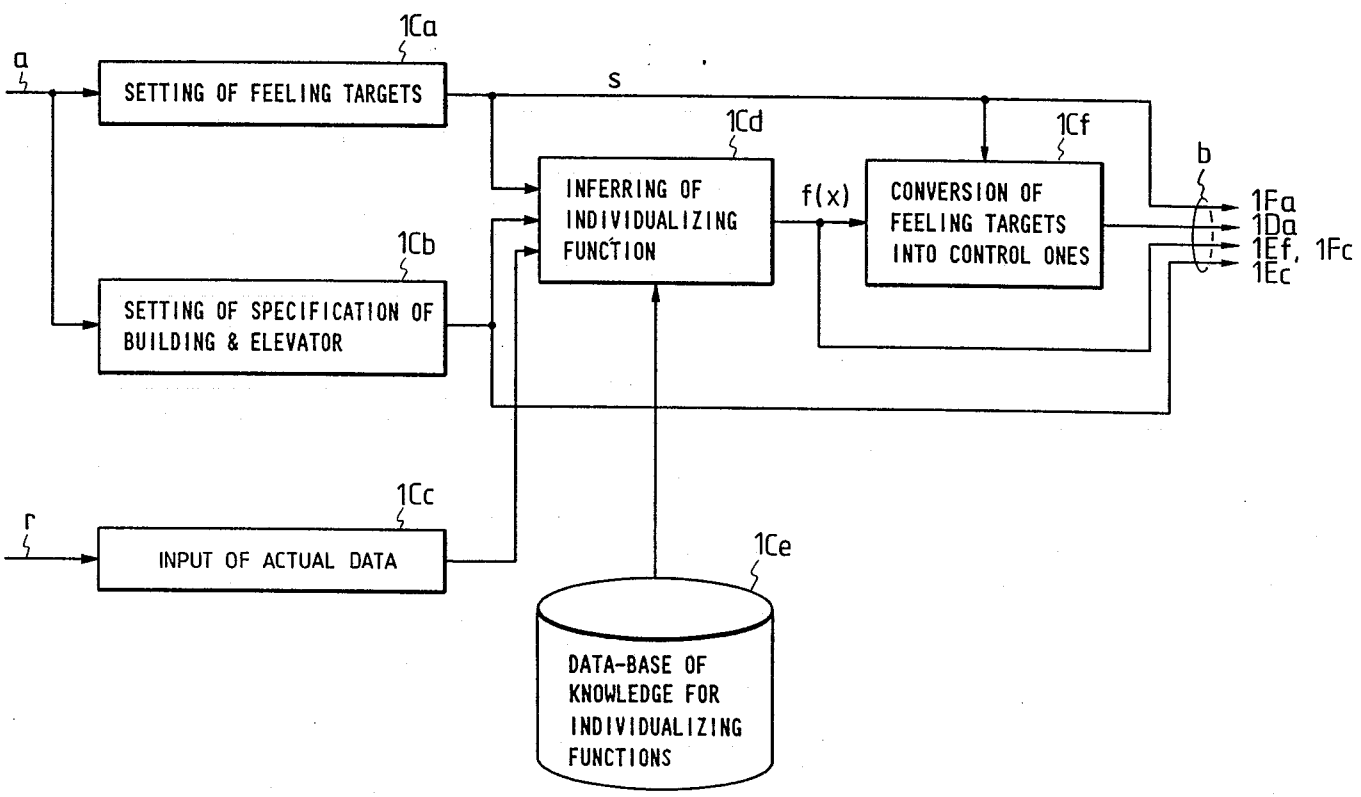
FIG. 6 is a functional block diagram showing the detailed configuration of the function of setting of multiple targets (block 1C) included in the individualizing support part of the overall functional block diagram of FIG. 5.

Referring to FIG. 6, there is shown a detailed functional block diagram of the setting of multiple targets 1C. As apparent from the fig., this functional block 1C includes subordinate functional blocks, i.e., setting 1Ca of feeling targets, setting 1Cb of specification of a building and an elevator input 1Cc of actual data (traffic demand patterns), inferring 1Cd of individualizing function data-base 1Cd of knowledge for individualizing functions, and conversion 1Cf of feeling targets into control targets In the following, each of the subordinate functional blocks will be explained in detail.

(1) Setting of feeling targets (1Ca)

This block 1Ca at first displays on the display device DD a menu of control items for selection thereof by an operator Example of the control items are listed in FIG. 7. In the following, the control items listed in FIG. 7 will be briefly explained;

Waiting time ($S_1$):

Time from the registration of a hall call by a person waiting at a certain floor to the arrival of a cage at the floor.

Rate of long-waiting ($S_2$):

Long-waiting means a waiting, the time of which exceeds 1 minute, for example. This rate is indicated as a rate of the number of long-waiting hall calls to the total number of hall calls generated for a predetermined time interval, e.g., 1 hour.

Riding time ($S_3$):

Time from the registration of a cage call by a passenger within a cage to the arrival of the cage at a cage call floor.

Cage-load factor ($S_4$):

Rate of the number of passengers within a cage to the capacity thereof The degree of the crowdedness within a cage can be indicated by this factor.

Rate of changing a reserved cage ($S_5$):

Rate of hall calls, the reservation (allotment) of which is changed from a cage to another cage. This is indicated as a rate of the number of such calls to the total number of calls generated for a predetermined time interval, e.g., 1 hour.

Time of information of a reserved cage ($S_6$):

Time from the registration of a hall call by a waiting person in an elevator hall to the time when he is informed of a reserved cage by an indicator in the hall.

Transportation capacity ($S_7$):

The number of persons capable of being transported for a predetermined time In the case where plural cages are operated, as in a group-controlled elevator system, this is indicated as the number of cages capable of serving a certain floor or floors.

Rate of first-arriving cages ($S_8$):

Rate of hall calls served by cages other than reserved cages to the total number of hall calls generated for a predetermined time interval.

Number of passing-by cages ($S_9$):

Number of times that cages other than a reserved cage passes by a hall call floor.

Amount of general information ($S_{10}$):

Amount of information such as events taking place in a building, weather forecast, time, etc., which is announced for waiting persons in elevator halls. There is no unit for this amount, which is widely used. In this embodiment, however, this is indicated by a product of the number of kinds of the information and the number of times of announcement for a predetermined time.

Rate of saving consumed electric power ($S_{11}$):

The consumed electric power greatly depends on the number of times of start and stop of cages. Therefore, this is represented by a reduction rate of the number of times of start and stop of cages.

Although eleven control items are listed in the table of FIG. 7, control items to be considered are not limited to those items. It is also possible to omit some of them and to add some others. Further, reference symbols $S_1$ to $S_{11}$ attached to the aforesaid control items denote variables indicating the feeling target of the respective control items.

When the menu of control items is displayed on the display device DD, the operator selects some control items which he thinks are necessary for determining a group-control method suited for an elevator system of a building. This selection is carried out by highlighting a necessary control item or indicating it by a cursor and manipulating a keyboard or a mouse of the input device ID, when the necessary item is highlighted or indicated.

FIG. 7 shows an example, in which six control items are selected, i.e., waiting time, riding time, cage-load factor, rate of changing a reserved cage, time of information of a reserved cage, and rate of first-arriving cages. In the fig., the selected control items are indicated with their numbers circled. At the same time as selection of the control items, the operator inputs the feeling targets for the respective control items selected by the input device ID.

The thus inputted feeling targets are stored for the successive processing in a table as shown in FIG. 8, which is defined within RAM of the processor $M_1$. The table is divided into plural columns for the feeling targets S, the control targets x and the individualizing functions f(x). Each column has small areas for every control item, as shown by $S_1$ to $S_{11}$, $x_1$ to $x_{11}$ and $f_1(x_1)$ to $f_{11}(x_{11})$. The areas for the latter two, i.e., the control targets x and the individualizing functions f(x), will be referred to later. There is further in the table an area for flag. Binary code "1" is set in a flag area corresponding to a control item selected by an operator.

In the case of the present embodiment, the code "1" is set in the flag areas for the selected control items, and the feeling targets set by an operator for the selected control items are stored in the areas corresponding to the selected feeling targets, i.e., in the areas $S_1$, $S_3$, $S_4$, $S_5$, $S_6$ and $S_8$.

Figure 9:
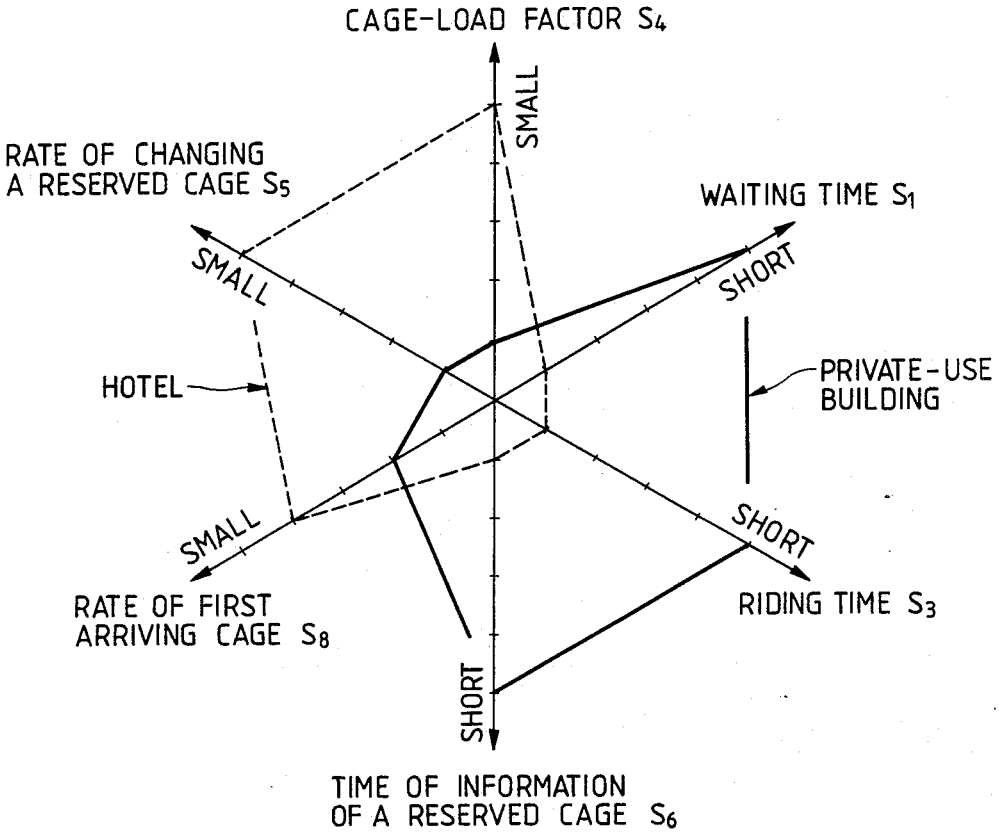
FIG. 9 is a radar chart, in which there are shown examples of setting targets of six control items.

Once the setting of the feeling targets has been completed, a radar chart as shown in FIG. 9 is displayed on the display device DD. As apparent from the figure, a pattern of the displayed radar chart will be different according to the manner of use of a building.

If a building is such a private-use building as is exclusively used by a single business institution, the radar chart based on the inputted feeling targets will become as shown by a solid line, whereas if a building is used for a hotel, it becomes as shown by a broken line. It will be seen from FIG. 9 that such a group-control method, that the weight of the control is put on the control items, such as the waiting time $S_1$, the riding time $S_3$ and the time of information of a reserved cage $S_6$, is required in the private-use building. On the contrary, the weight of the control is put on the control items, such as the cage-load factor $S_4$, the rate of changing a reserved cage $S_5$, and the rate of first arriving cages $S_8$, in the hotel building, which are not regarded as important in the former building.

(2) Setting of specification of a building and an elevator system (1Cb)

This subordinate functional block 1Cb executes the setting of specification of a building and an elevator system, such as a manner of use of a building, a number of elevator cages installed, a rated running speed thereof, a number of floors to be served and so on. The setting work is carried out by the operator's manipulating the input device ID, and therefore, data concerning the above are supplied through the line b.

Similarly to the aforesaid functional block 1Ca, also the result of this functional block 1Cb can be displayed on the display device DD, for example, in the form of a radar chart, whereby an operator can easily set the specification of a building and an elevator system on the interactive basis. The setting work of the specification will be much facilitated, if it can be carried out in the question-and-answer basis as follows, for example.

"What kind of your building? Select the number:
1. a private-use building
2. a hotel building
3. a mixed-residential building
4. a department store building"

(3) Inferring of individualizing functions (1Cd) and data-base of knowledge thereof (1Ce)

Figure 10:
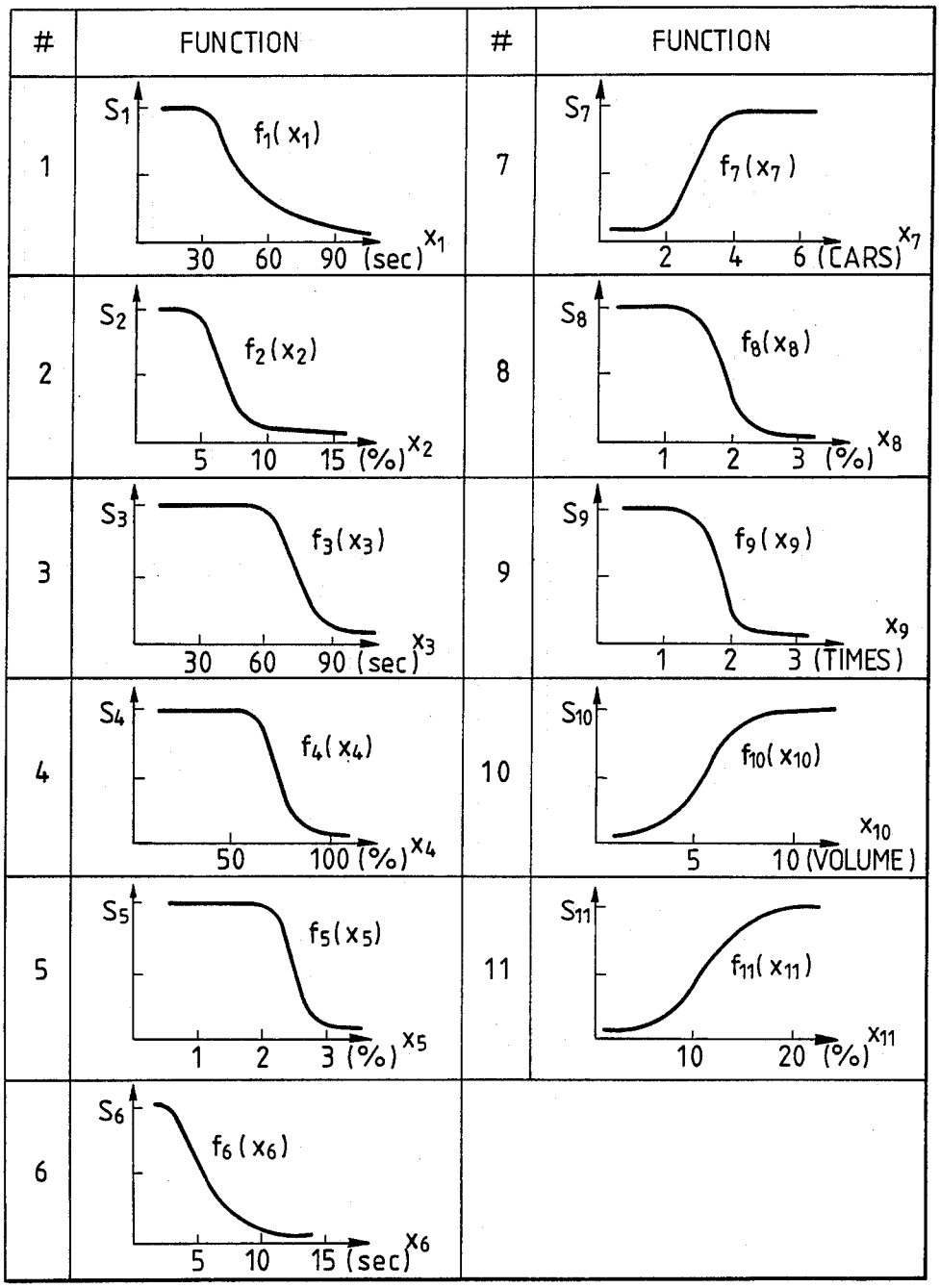
FIG. 10 is a table showing an example of various individualizing functions used in the functional block 1C of FIG. 6.

The explanation will be at first given of the database of knowledge of inference of individualizing functions. FIG. 10 shows examples of individualizing functions for the respective control items, which are provided as data-base. In the figure, the number # of the respective functions correspond to the number attached to the control items shown in FIG. 7.

As will be understood from FIG. 10, each individualizing function, which is similar to a membership function in a fuzzy theory, is used for converting the feeling targets $S_1$ to $S_{11}$ into the control targets $x_1$ to $x_{11}$, as described later. Further, although only one function is shown for one control item in FIG. 10, there are provided plural functions for one control item, which are selectively used in accordance with the various conditions for control. This will be explained in detail, referring to Figs. 11*a* to 11*c*.

Figure 11A:
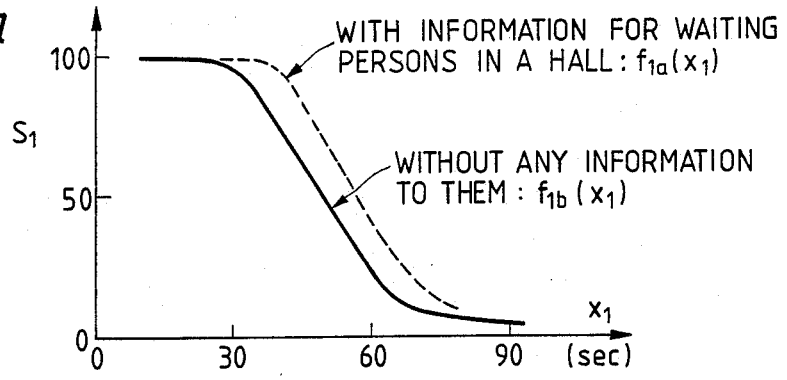
FIGS. 11*a* to 11*c* show examples of variations of individualizing functions provided in accordance with various conditions.

In these figures, there are shown examples of the individualizing functions $f_1(x_1)$, $f_3(x_3)$, $f_4(x_4)$ for the control items of the waiting time, the riding time and the cage-load factor. For example, in the case where a general information, such as information of events taking place in a building, weather forecast and time, is given to persons waiting in elevator halls, their irritation will not become so strong, even if the arrival of a cage somewhat delayed. As shown in FIG. 11*a*, therefore, a function $f_{1a}(x_1)$ with information to the waiting persons is shifted to right, i.e., to the side of the longer waiting time, compared with a function $f_{1b}(x_1)$ without any information of that kind to the waiting persons.

Figure 11B:
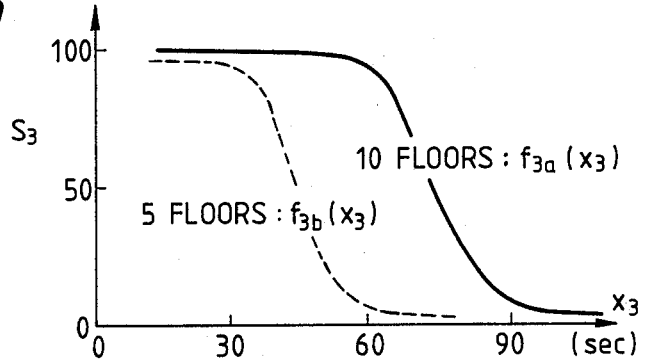

For the control item of the riding time, as shown in FIG. 11*b*, there is used the floor range to be served (the difference between floors) as a parameter for selecting one of a function $f_{3a}(x_3)$ for the long-range operation (10 floors in this case) and a function $f_{3b}(x_3)$ for the short-range operation (5 floors). The long riding time means that the number of times of stop of a cage is small on an average, whereas the short riding time means that a cage stops very often. If the short riding time is set, a cage can respond to calls generated for the short-range operation and the number of times of stop of the cage will increase, with the result that passengers within the cage are irritated. Therefore, the function $f_{3b}(x_3)$ for the short-range operation is shifted to right, i.e., to the side of the shorter riding time, rather than the function $f_{3a}(x_3)$ for the long-range operation.

Figure 11C:
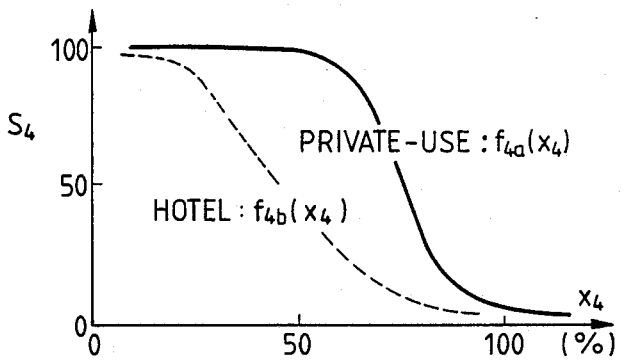

From the similar reason, there are provided two functions $f_{4a}(x_4)$ and $f_{4b}(x_4)$ for the control item of the cage-load factor, which are selected in accordance with the manner of use of a building, as shown in FIG. 11c.

Furthermore, in the examples shown in FIG. 8 or 10, one of the feeling targets $S_1$ to $S_{11}$ exactly corresponds to one of the control targets $x_1$ to $x_{11}$. However, it is also possible to make two or more of the control targets $x_1$ to $x_1$ correspond to one of the feeling targets $S_1$ to $S_1$.

The individualizing functions as mentioned above are provided as the data-base 1Ce of knowledge for the individualizing functions. In the functional block 1Cd, adaptive functions are selected in accordance with predetermined inference rules on the basis of the feeling targets from the functional block 1Ca and data of the specification of a building and an elevator from the functional block 1Cb, as well as the actual data from the functional block 1Cc.

In the following, there will be explained the aforesaid inference rules, taking the cases as shown in Figs. 11a to 11c as examples. As already described, these rules are provided in the form of the production rule as follows.

RULE C-1:

If "the announcement of a general information is carried out", then $f_{1a}(x_1)$, else $f_{1b}(x_1)$.

RULE C-2:

If "the number of floors of the range to be served is from 5 floors to 10 floors", then $f_{3a}(x_3)$.

RULE C-3:

If "the number of floors of the range to be served is less than 5 floors", then $f_{3b}(x_3)$.

RULE C-4:

If "a building is a private-use building", then $f_{4a}(x_4)$.

RULE C-5:

If "a building is a hotel building", then $f_{4b}(x_4)$.

In the same manner as described with reference to the functional block 1Ca, the thus selected individualizing functions are stored in the corresponding areas $f_1(x_1)$, $f_3(x_3)$, $f_4(x_4)$, $f_5(x_5)$, $f_6(x_6)$ and $f_8(x_8)$ of the table of FIG. 8 for the use in the successive processing.

(4) Conversion of feeling targets into control targets (1Cf)

The individualizing functions determined by means of the inference in the functional block 1Cd are transmitted to this functional block 1Cf and used therein for converting the feeling targets into the control targets having the physical values.

Figure 12:
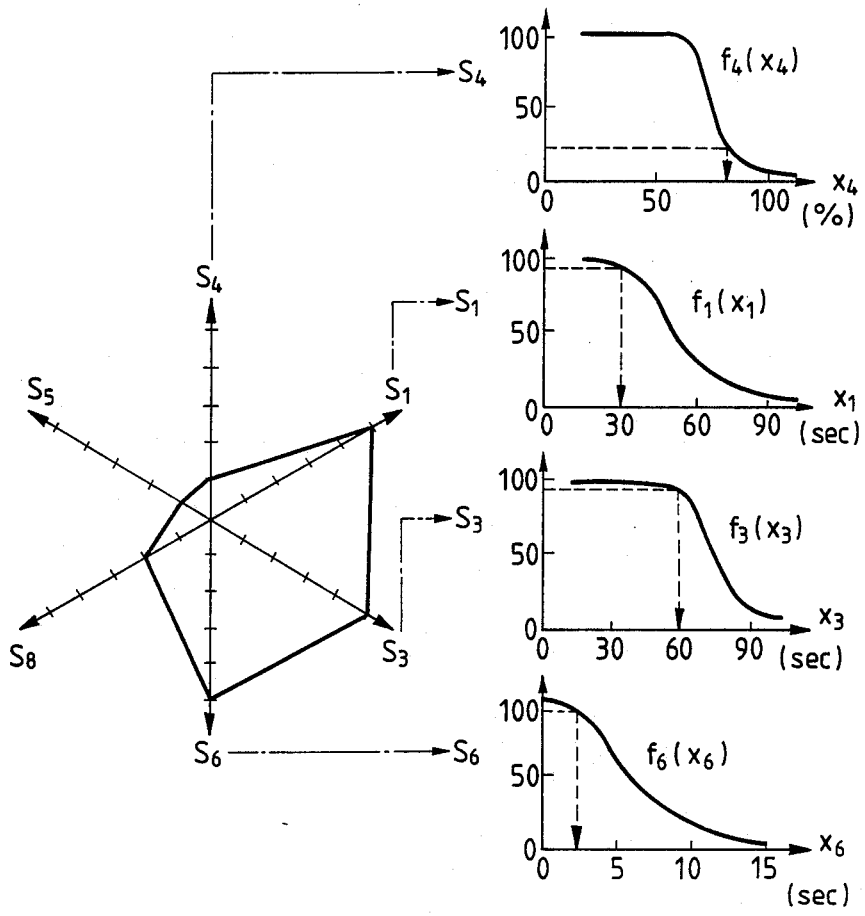
FIG. 12 is a drawing for explaining the principle of conversion of feeling targets to control targets.

Referring to FIG. 12, the conversion operation executed in the functional block 1Cf will be explained. In the figure, there are shown as examples the conversion operation of the feeling targets of the four control items of the waiting time ($S_1$), the riding time ($S_3$), the cage-load factor ($S_4$) and the time of information of a reserved cage ($S_6$).

The feeling targets, which are set in the form of five steps of psychological feeling as shown in the radar chart, are indicated in 100 percent on an ordinate of each individualizing function, and therefore one step of the psychological feeling corresponds to 20 percent. The control targets are indicated in respective physical unit on an abscissa of each individualizing function.

Therefore, the feeling targets $S_1$, $S_3$, $S_4$ and $S_6$ are converted into the corresponding control targets $x_1$, $x_3$, $x_4$ and $x_6$ by using the respective individualizing functions $f_1(x_1)$, $f_3(x_3)$, $f_4(x_4)$ and $f_6(x_6)$, as follows.

| Control item | Feeling target | Control target |
|---|---|---|
| Waiting time ($S_l$) | 100 | 30 sec. |
| Riding time ($S_3$) | 100 | 60 sec. |
| Cage-load factor ($S_4$) | 20 | 80% |
| Time of information of a reserved cage ($S_6$) | 100 | about 2 sec. |

The converted control targets are transmitted to the functional block 1D, i.e., the determination of a group-control method and parameters, as described in the following section. In practice, the thus converted control targets are once stored in the corresponding areas $x_1$, $x_3$, $x_4$, $x_5$, $x_6$ and $x_8$ of the table of FIG. 8, and they are read out therefrom upon the processing in the functional block 1D.

Further, there are often cases where the targets of the plural control items required by an operator are difficult to be satisfied simultaneously. Accordingly, it is required to put the different weight or priority on the respective control items. In such cases, the weight or priority can be determined with reference to a relation table among the respective control items and by using the method of a so called analytical hierarchy process (AHP) (cf. T. L. Saaty "The Analytical Hierarchy Process" McGraw Hill (1980)).

Moreover, in the present embodiment, the feeling targets are inputted in order to set the degree of the necessary control items. The setting of targets of the control items by the feeling values is not essential to the present invention. If an operator is well accustomed to the management of a group-controlled elevator system, it is of course that targets of the necessary control items can be set with the control target having the physical value, as mentioned in this section.

3.1.2 Determination of a control method and parameters (1D)

Figure 13:
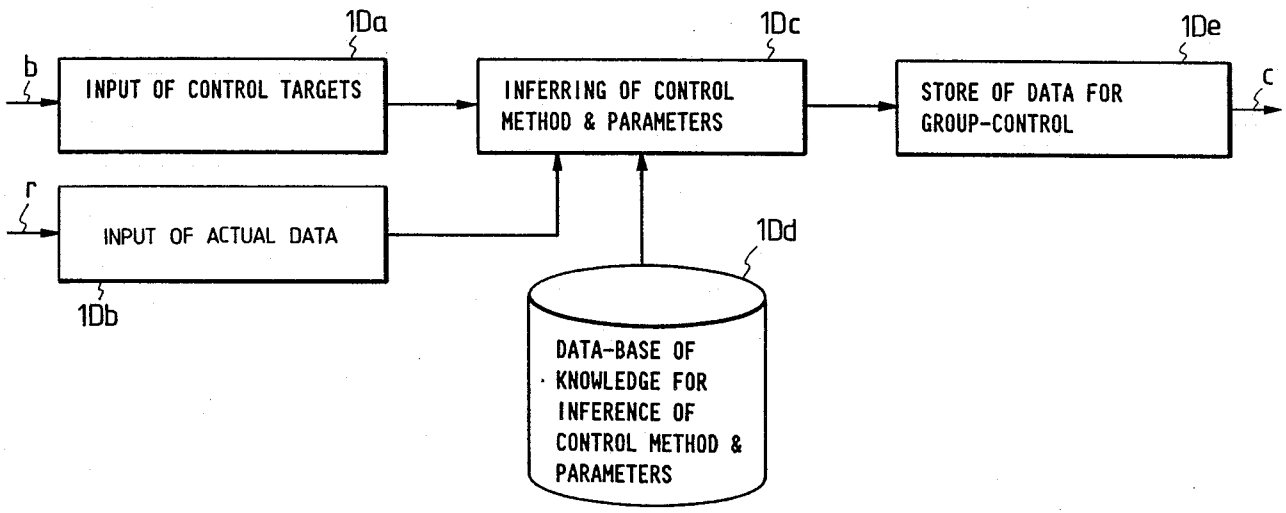
FIG. 13 is a functional block diagram showing the detailed configuration of the function of determination of a control method and parameters (block 1D) included in the individualizing support part of the overall functional block diagram of FIG. 5.

Referring next to FIG. 13, the explanation will be made of the functional block 1D, i.e., the determination of a control method and parameters. As shown in the figure, this functional block 1D includes the subordinate functional blocks of input 1Da of control targets, input 1Db of actual data, inferring 1Dc of a control method and parameters, data-base 1Dd of knowledge for inference of the control method and parameters and store 1De of data for group-control.

The major function of this functional block 1D is the inference of a method for group-controlling the plural elevator cages, which is most suited for satisfying the targets of the control items set in the manner as already described. This inference of a group-control method is carried out by the functional block 1Dc in accordance with the data-base provided in the block 1Dd. Before the explanation of the data-base, there will be next described various basic algorithms for achieving the targets of the control items required by an operator (1) Detailed description of individual algorithms (A) Algorithm for controlling the waiting time Recently, there is mainly used an algorithm for call allotment, in which when a hall call is generated, there are calculated evaluation values of all of group-controlled cages in accordance with a predetermined evaluation function in view of all hall calls, which have been already allotted to the cages. The generated hall call is allotted to a cage having the minimal one of the evaluation values calculated (cf. Japanese patent publication No. JP-B-57/40068 (1982), for example). The aforesaid evaluation function includes an evaluation index of a waiting time. Although there have been already known various schemes of how to determine the evaluation index of a waiting time, the following four schemes are prepared in the present embodiment.

a. minimal waiting-time scheme:

Waiting times are predicted or estimated with respect to all of the hall calls which have been already allotted to a cage at the time when a hall call is generated. The minimal one among the waiting times predicted is made an evaluation index of a waiting time for the cage.

b. Maximal waiting-time scheme:

Among the waiting times predicted similarly to the scheme a. above, the maximal one is made an evaluation index of a waiting time for the cage.

c. Minimal deviation scheme:

Among the waiting times predicted similarly to the scheme a. above, the waiting time, which has the minimal deviation from a predetermined value, is made an evaluation index of a waiting time for the cage.

d. Psychological irritation scheme:

Waiting times are predicted with respect to a generated hall call and already allotted hall calls, which exist behind the generated hall call in the traveling direction of a cage. The sum of squares of the waiting times predicted is made an evaluation index for the cage.

The aforesaid schemes are provided as the data-base 1Dd, and one of them is selected in accordance with production rules as mentioned later. Further, a predicted waiting time $t_w$ described in the aforesaid schemes are calculated in accordance with the following formula.

$t_w$=(an elapsed time from the registration of a hall call to the present time)+(a time from the present time to the arrival of the cage at a hall call floor) (1)

Assuming that an evaluation index of a predicted waiting time is indicated by WT, an evaluation function for obtaining an evaluation value $\phi_n$ for a cage n is expressed by the following formula:

$$\phi_n = WT_n \quad (2)$$

$n=1, 2, \ldots, N$ wherein N denotes a total number of group-controlled elevator cages. A hall call is allotted to a cage having the minimum value among the evaluation values $\phi_n$ calculated in accordance with the formula (2) above.

This algorithm makes a great contribution to the improvement of some of the control items as listed in the table of FIG. 7, especially to the reduction of the average waiting time and the rate of long-waiting, since it can manage the waiting time of individual hall calls by means of the predicted waiting time. Since, however, it does not necessarily consider the overall balance of the operation of the elevator cages, the string-of-cages operation is easy to occur. Then, an index evaluating the overall operational condition of cages is taken into account as an element of an evaluation function expressed by the formula (2), in addition to the evaluation index WT of the waiting time.

Figure 14:
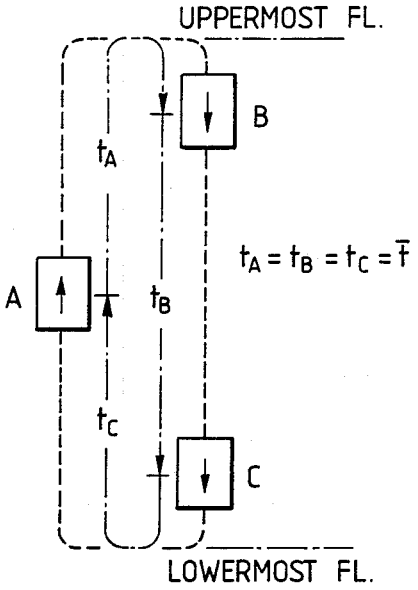
FIG. 14 is a drawing for explaining the equal interval operation of the plural elevator cages.

As described in the article "Forecasting Control System for Elevators - Development of CIP/IC System - " by Takeo Yuminaka et al, "Hitachi Hyoron (Review)" Vol. 54 (1972), No. 12, pp. 67 to 73, the ideal operation condition in an elevator system is such that the operation time-interval of the elevators is controlled so as to be equal, and FIG. 14 shows an example thereof In FIG. 14, there is shown an example in the case of three elevator cages A, B and C, which are group-controlled. As shown by a broken line in the figure, the going and returning travel of the three cages can be regarded as forming a closed touring path between a lowermost floor and an uppermost floor. In such a touring path, a cage traveling upward is arranged on the broken line on the lefthand side and a cage traveling downward on the broken line on the righthand side.

In the operational state shown, the cage A travels upward around middle floors, the cage B travels downward near the uppermost floor, and the cage C travels downward near the lowermost floor. Assuming that the time-intervals between cages A and B, cages B and C, and cages C and A are $t_A$, $t_B$, $t_C$, respectively, the relation of $t_A = t_B = t_c = (=\bar{t})$ is achieved in the ideal operation state of an elevator system, wherein $\bar{t}$ denotes a standard operation time-interval, which is obtained by dividing the touring time $T_t$, which is required for one elevator cage to circulate around the touring path, by the total number N of group-controlled elevator cages.

Incidentally, the following should be noted. Namely, the touring time $T_t$ changes in accordance with the state of generation of calls, for example, and hence is not always constant Further, also the total number N of the group-controlled elevator cages is not fixed, but is changed in accordance with the traffic demand. As a result, the standard operation time-interval $\bar{t}$ changes.

In practice, however, there are scarcely the operational state as shown in FIG. 14. Therefore, in the prior art described in the article referred to above, there is produced a jump signal, which indicates an imaginary position of an elevator cage, in accordance with a predetermined rule in response to an actual position of the cage, and a service zone is set on the basis of the jump signal. The hall call, which is generated within the service zone, is preferentially allotted to the elevator cage, whereby the equal time-interval operation is created. The service zone is called an equal time-interval preferential zone, which is indicated by reference symbol $Z_p$.

Figure 15B:
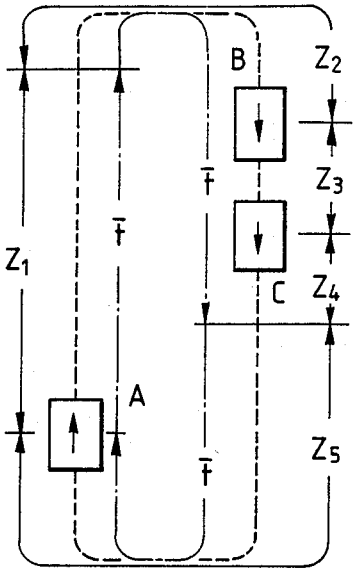
FIG. 15*a* to 15*c* are drawings for explaining an equal time-interval preferential zone in accordance with the position of the plural cages.
Figure 15A:
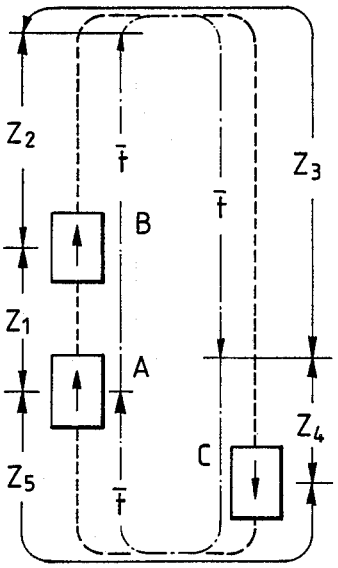
Figure 15C:
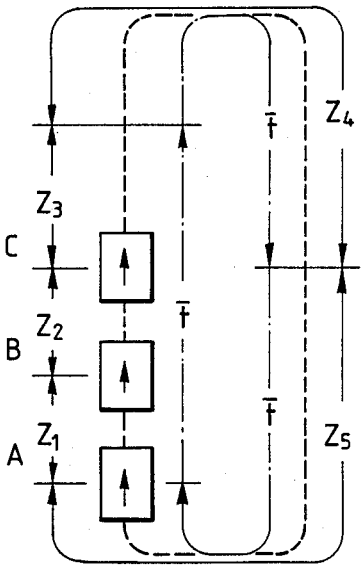

Referring to FIGS. 15*a* to 15*c*, there will be described three typical examples of the equal time-interval preferential zone $Z_p$, which are different in accordance with the positioning of the three cages. As apparent from the figs., the touring path of the three elevator cages is divided into five zones $Z_1$ to $Z_5$ in accordance with the traveling direction and position of the respective cages and the standard operation time-interval $\bar{t}$. Generally speaking, a touring path served by the number N of elevator cages is divided into zones of the number of (2N−1).

In the case of the traveling direction and positioning of the cages A, B, C as shown in FIG. 15*a*, for example, the zone $Z_1$ is defined between the floors, at which the cages A and B are positioned; the zone $Z_2$ from the floor of the cage B to the floor, which is by the number of floors in response to the standard operation time-interval $\bar{t}$ apart from the floor of the cage A; the zone $Z_3$ from the end of the zone $Z_2$ to the floor, which is by the number of floors in response to the standard operation time-interval $\bar{t}$ apart from the end of the zone $Z_2$; $Z_4$ from the end of the zone $Z_3$ to the floor of the cage C;

and the zone $Z_5$ between the floors of the cages C and A.

Assuming in the case mentioned above that the equal time-interval preferential zones for the elevator cages A, B, C are indicated by $Z_{PA}$, $Z_{PB}$, $Z_{PC}$, respectively, they can be expressed as follows;

$$\left.\begin{aligned} Z_{PA} &= \{Z_1, Z_2\} \\ Z_{PB} &= \{Z_3, Z_4\} \\ Z_{PC} &= \{Z_5\} \end{aligned}\right\} \quad (3)$$

In this case, a hall call generated in the zones $Z_{PA}$, $Z_{PB}$, $Z_{PC}$ is preferentially allotted to the cages A, B, C, respectively. A hall call generated in the zone $Z_2$ is never allotted to the cage B, but to the cage A, because the zone $Z_2$ is included in the preferential zone $Z_{PA}$ for the cage A.

Next, in the case where the three cages are positioned as shown in FIG. 15*b* and travel in the respective directions as shown by arrows in the figure, the zone $Z_1$ to $Z_5$ are formed as shown in the figure. Therefore, the preferential zones $Z_{PA}$, $Z_{PB}$, $Z_{PC}$ for the three cages become as follows;

$$\left.\begin{aligned} Z_{PA} &= \{Z_1, Z_2\} \\ Z_{PB} &= \{Z_3, Z_4\} \\ Z_{PC} &= \{Z_5\} \end{aligned}\right\} \quad (4)$$

Further, in the case where the cages are positioned as shown in FIG. 15*c* and travel in the respective directions as shown by arrows in the fig., the zone $Z_1$ to $Z_5$ are formed as shown in the fig.. Therefore, the preferential zones $Z_{PA}$, $Z_{PB}$, $Z_{PC}$ becomes as follows;

$$\left.\begin{aligned} Z_{PA} &= \{Z_1, Z_2, Z_3\} \\ Z_{PB} &= \{Z_4\} \\ Z_{PC} &= \{Z_5\} \end{aligned}\right\} \quad (5)$$

As will be understood from FIGS. 15*a* to 15*c* and the foregoing description, the equal time-interval preferential zone $Z_p$ changes every minute in accordance with the position of the elevator cages and the standard operation time-interval $\bar{t}$.

Let us return to the explanation of the evaluation index of the call allotment taking account of an index evaluating the overall operational condition of cages. If an evaluation index of the equal time-interval preferential zone as mentioned above is taken as an index evaluating the overall operation condition of cages, the formula (2) is corrected as follows.

$$\phi_n = (WT - k_p Z_p)_n \quad (6)$$

$n = 1, 2, \ldots, N$

In the formula (6) above, $Z_p$ is an evaluation index concerning the equal time-interval preferential zone and assumes the value of 1.0, when a hall call is generated in a corresponding preferential zone, and the value of 0, when there occurs no hall call in the preferential zone. Further, $k_p$ is one of control parameters, which has the function of converting the dimension. The control parameter $k_p$ also functions as a weight coefficient representing the degree of consideration of the evaluation index $Z_p$.

For example, therefore, if the parameter $k_p$ is made large, the influence of evaluation index $Z_p$ of the preferential zone on the evaluation value $\phi_n$ increases, and resultantly the influence of the evaluation index WT of the waiting time thereon becomes relatively small. On the contrary, if the parameter $k_p$ is made small, the influence of the evaluation index $Z_p$ is reduced, and that of the evaluation index WT becomes relatively large. In this manner, the degree of consideration of control items in the call allotment can be easily adjusted by selection of the value of the control parameter.

As described above, in the present invention, since the equal time-interval preferential zone is taken into consideration, the operational state of the elevator cages can be improved in a relatively early time, even if the string-of-cages operation as shown in FIG. 15*c* occurs. Therefore, the average waiting time or the rate of the long-waiting is much improved.

Figure 16:
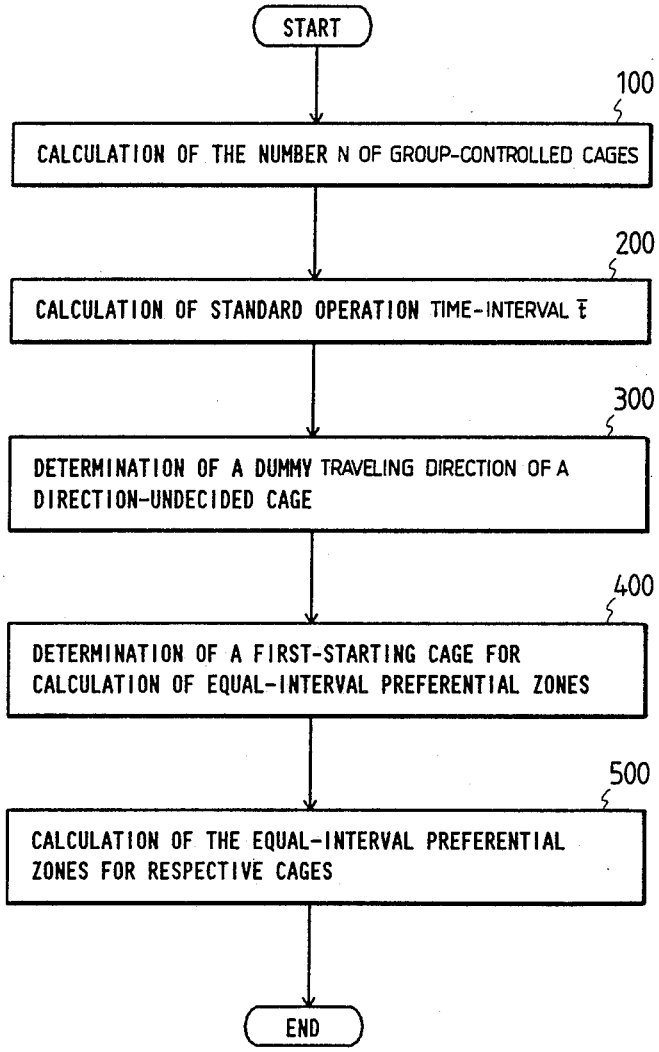
FIG. 16 is a flow chart of the processing operation for establishing the equal time-interval preferential zone.
Figure 19:
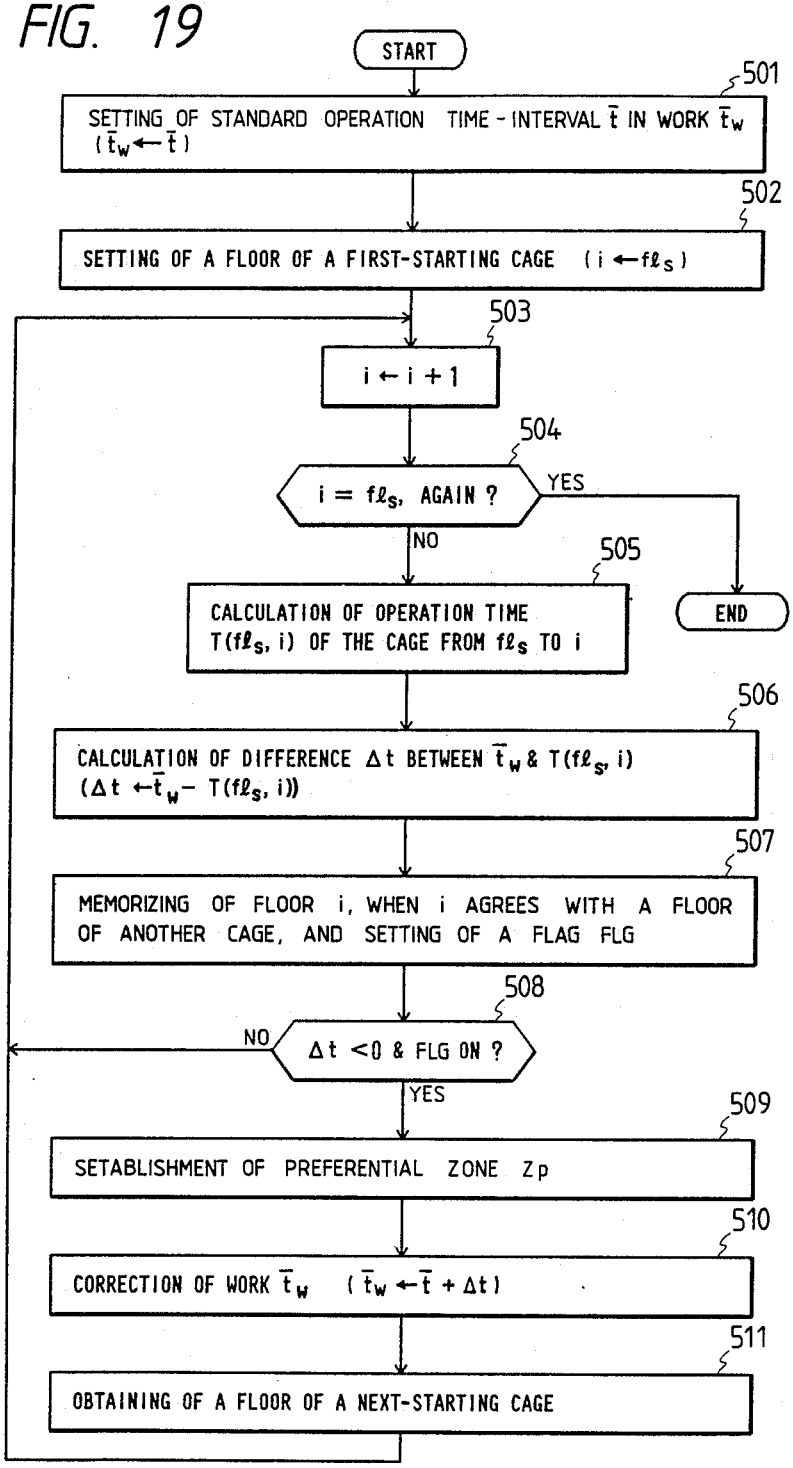
FIG. 19 is a flow chart showing the details of a processing step of calculation of the equal time-interval preferential zone included in the flow chart of FIG. 16.

Referring next to FIG. 16, the formation of an equal time-interval preferential zone will be explained In the figure, there is shown a flow chart of the processing for the formation of an equal time-interval preferential zone. In this processing, there is used a table, as shown in FIG. 17*a*, which is provided in RAM of the processor $M_1$. In the table, there are prepared plural areas for variables as shown in the fig.. Among the areas, however, only areas for the number of group-controlled cages N and the standard operation time-interval $\bar{t}$ will be referred to in the description of the flow chart of FIG. 16. The remaining areas will be referred to later, with reference to the description of a flow chart of FIG. 19.

At first, the number N of cages, which are to be subject to the group-control, is calculated at step 100. There is a case where some of plural elevator cages installed in a building are operated on the stand-alone basis for exclusive use for a certain specific purpose. Since such elevator cages are to be excepted from the group-control, the number of elevator cages to be subject to the group-control is obtained by the calculation in this step. The calculated N is stored in the relevant area of the table shown in FIG. 17*a* for use in the successive processing. Then, at step 200, the standard operation time-interval $\bar{t}$ according to the traffic demand at that time is calculated by dividing the present touring time $T_t$ by the number N of group-controlled elevator cages obtained at step 100. Also the thus obtained $\bar{t}$ is stored in the relevant area of the table of FIG. 17*a* for use in the successive processing.

As understood from FIGS. 15*a* to 15*c* and the foregoing description, the traveling direction of all the cages must be known in order to establish the equal time-interval preferential zones for the respective cages. If there is an elevator cage, which has served to a call and is now under the waiting (which is indicated as a direction-undecided cage in the flow chart of FIG. 15), the direction of start of the cage is necessary to be provisionally decided, which direction is called a dummy traveling direction. The determination of the dummy direction of a direction-undecided cage is carried out at step 300, if such a direction-undecided cage occurs.

Figure 18A:
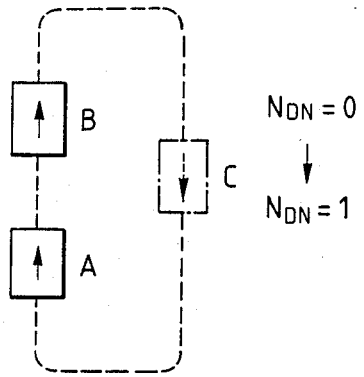
FIGS. 18*a* to 18*c* are drawings for explaining methods of determining a dummy direction of a direction-undecided cage for establishing the equal time-interval preferential zone.
Figure 18B:
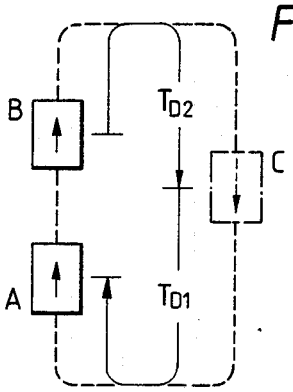
Figure 18B:
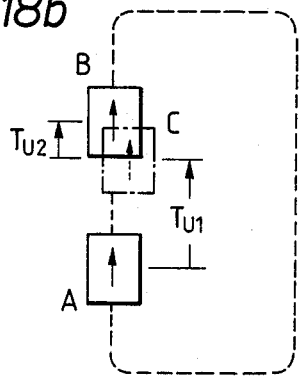

An algorithm of determining the dummy direction of a direction-undecided cage will be explained, referring to FIGS. 18*a* to 18*c*. In the figures, it is assumed that cage C is a direction-undecided cage. The following three schemes are provided for determination of the dummy direction in the present embodiment.

a. Direction-balance scheme:

The principle of this scheme is shown in FIG. 18*a*. As shown in the figure, in this scheme, the number (Nhd UP) of upward traveling cages and that ($N_{DN}$) of downward traveling cages are at first counted. The dummy direction of a direction-undecided cage is decided in the traveling direction of the smaller number. In the example shown, since $N_{UP}$ is 2 (the cages A and B) and $N_{DN}$ is zero, the dummy direction of the cage C is decided in the downward direction, whereby $N_{DN}$ is made 1 and the numbers of the upward traveling cages and the downward traveling cages approach the balance.

b. Time-interval balance scheme:

The principle of this scheme is shown in FIG. 18*b*. In this scheme, the dummy direction of the cage C is tentatively decided in both the upward and downward directions, as shown in the figure. After that, the time-intervals (or distance-intervals) between adjacent cages are calculated, and the dummy direction of the cage C is finally decided in the direction, by which the aforesaid calculation results are better balanced.

In FIG. 18*b*, it is assumed that when the dummy direction of the cage C is decided in the downward direction, the time-intervals between the cages C and A and between the cages B and C are $T_{D1}$ and $T_{D2}$, respectively, and when the dummy direction of the cage C is decided in the upward direction, the time-intervals between the cages A and C and between the cages C and B are $T_{U1}$ and $T_{U2}$, respectively. The determination of the dummy direction is carried out in accordance with the result of the following calculation:

$$\min\left\{ \sum_{i=1}^{2} |T_{Di} - t|, \sum_{i=1}^{2} |T_{Ui} - t| \right\} \tag{7}$$

wherein the symbol "min{}" means that the smallest one of the calculated results within the braces is taken as a calculation result of the formula above. This is applied to all formulas appearing later. On the contrary, although also the symbol "max {}" appears in a formula later, it means that the largest one of components within the braces is taken as a calculation result of the formula.

Figure 18C:
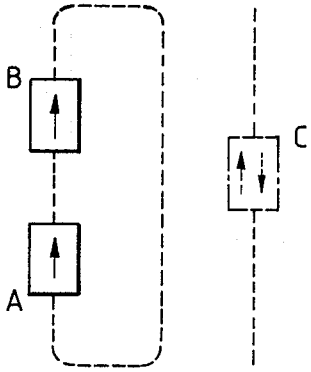

According to this scheme, although the algorithm may be somewhat complicated, a dummy direction can be decided with a good balance, even for a cage positioning near the uppermost or lowermost floor.

c. Bidirection assignment scheme:

According to this, both the upward and downward directions are assigned to the cage C, as shown in FIG. 18*c*. When this scheme is employed, therefore, the preferential zones have to be formed by the cages A and B only, the traveling directions of which are already decided.

Among the aforesaid three schemes, the schemes a and b are employed in the present embodiment, and it is assumed that the downward direction is assigned to the cage C.

Returning to the flow chart of FIG. 16, a first-starting elevator cage is determined at step 400. As understood from the fact that, in FIGS. 15*a* to 15*c*, the equal time-interval preferential zone are always considered with the position of the cage A made as a reference, it is necessary to determine a cage, which is made a reference, for the purpose of calculating the preferential zones. Such a reference cage is a first-starting cage. There are provided the following three schemes of the algorithm for determination of a first-starting cage.

a. Specific cage start scheme:

In this scheme, a specific cage is always started first. This scheme is one of the simplest algorithm. According to this, however, the effect of the equal time-interval preferential zones is likely to greatly depend on the positioning of the cages, including their traveling direction, at that time. Further, the examples shown in FIGS. 15*a* to 15*c* uses this scheme, i.e., the cage A is always started first.

b. Highest/lowest cage start scheme:

According to this, a cage, which is at the highest or lowest floor at that time, is started first. This is also one of the simplest algorithm, and therefore, similarly to the aforesaid scheme a., the effect of the equal time-interval preferential zones is likely to greatly depend on the positioning of the cages at that time.

c. Most approximating cage start scheme:

In this scheme, at first, the time-intervals between adjacent cages are calculated, and a cage having the smallest time-interval there among is first started. Namely, assuming that the time-intervals between adjacent cages A and B, B and C, and C and A are $T_{AB}$, $T_{BC}$ and $T_{CA}$, respectively, a cage, which satisfies the following relation, is started first.

$$\min\{T_{AB}, T_{BC}, T_{CA}\} \tag{8}$$

This scheme is a somewhat complicated algorithm, however according to this, the effect of the equal time-interval preferential zone can be made maximum.

When a first-starting cage is determined in accordance with either one of the algorithms as mentioned above, a number of the floor, at which the first-starting cage is positioned, is stored as a variable $fl_s$ in the relevant area of the table of FIG. 17*a* for use in the successive processing.

Next, at step 500 in the flow of FIG. 16, the equal time-interval preferential zones for the respective cages are calculated. Details of this step will be explained with reference to a flow chart of FIG. 19 and the tables of FIGS. 17*a* and 17*b*.

After start of the processing of this flow chart, at step 501, the standard operation time-interval $\bar{t}$, which is read out from the relevant area of the table of FIG. 17*a*, is set in work table $\bar{t}_w$ of the same table. At step 502, the number $fl_s$ of the floor, which is read out from the relevant of the table of FIG. 17*a* , is set in the area for the floor number i, in which i functions as a loop variable in the flow of this processing. At step 503, the floor number i is added by one, whereby a new floor number i is set in the area i of the table. After setting of the new floor number i, the processing operation goes to step 504, at which it is discriminated whether or not the newly set floor number i becomes equal to $fl_s$, again.

This discrimination results from the following. As already described, the touring path of elevator cages cans be considered as a closed loop. If, therefore, the floor number i is increased one by one, it reaches the number of one of the end floors, and thereafter, if the floor number i is further increased, it reaches the number of the other end floor If the floor number i is further increased, it again reaches the number of the floor, from which this processing starts. Although step 503 is shows by (i+1) only for the purpose of simplifying the flow chart, it is to be understood that steps 503 and 504 implies the processing as mentioned above If it is discriminated at step 504 that the floor number i became $fl_s$, again, the processing operation of this flow chart ends. Otherwise, the processing operation goes to step 505, at which the operation time $T(fl_s,i)$ required for a cage to travel between the floors $fl_s$ and i is calculated and stored in the relevant area of the table of FIG. 17*a*. Next, at step 506, the difference $\Delta t$ between the standard operation time-interval $\bar{t}$ and the operation time $T(fl_s,i)$ is calculated and stored in the relevant area of the table. Further, at step 507, it is retrieved whether or not there is a preceding cage, which stops at the floor i. If there is such a cage, the floor i is memorized and a binary code "1" is set in the flag area FLG of the table.

At step 508, it is discriminated whether or not the difference $\Delta t$ is negative and the flag FLG is set. The negative difference $\Delta t$ means that the operation time $T(fl_s,i)$, i.e., the time elapsed from the start of the cage to the present time, already exceeds the standard operation time-interval $\bar{t}$, and the flag FLG means that a preceding cage stops at the floor i.

If, therefore, both the conditions are satisfied in the discrimination of step 508, the equal time-interval preferential zone $Z_p$ for the cage has to be established in the range from the floor at which the cage starts to the floor i. This is carried out at step 509. The established preferential zone $Z_p$ is stored in the relevant area of the table of FIG. 17*b*. On the contrary, if the condition is not satisfied at step 508, the processing operation returns to step 503, at which the floor number i is further added by one. This means that the preferential zone is further extended by one floor. Thereafter, the same processing as described above is repeated until the discriminating condition at step 508 is satisfied.

After the preferential zone $Z_p$ is established at step 509, the standard operation time-interval $\bar{t}$ stored in the work table $\bar{t}_w$ is corrected by adding the difference $\Delta t$ to it at step 510, and the corrected time-interval is stored again in the work table $\bar{t}_w$. Thereafter, at step 511, there is obtained the floor, at which a cage to be started next is positioned. After the floor of the next-starting cage is obtained, the processing returns to step 503 and the same processing operation as described above is repeated, whereby the equal time-interval preferential zone for the next-starting cage is calculated.

In this manner, the preferential zones of the respective cages are established. If the processing operation goes to step 504 after the preferential zone of the last cage has been established at step 509, the answer of this discriminating step changes to YES, i.e., the number i of floor becomes equal to $fl_s$, again, and the whole processing operation of the calculation of the equal time-interval preferential zones (step 500 in the flow chart of FIG. 16) ends.

Further, in the foregoing, the calculation of the equal time-interval preferential zones for the respective cages have been described. However, equal distance-interval preferential zones can be obtained by somewhat modifying the flow chart of FIG. 19. Namely, such a modification can be easily realized by substituting a standard operation distance-interval and a distance difference for the standard operation time-interval $\bar{t}$ and the time difference $T(fl_s,i)$ in steps 501 and 505, respectively. It is of course that also in the remaining steps the appropriate alteration must be added in accordance with the above mentioned substitution. However, it is very easy for one skilled in the art.

By the establishment of the above mentioned preferential zones, a hall call generated in a preferential zone is preferentially allotted to a cage having the preferential zone. Further, although, in the embodiment described above, hall calls generated in a certain preferential zone are allotted to a cage having the preferential zone with an equal priority, the following alteration can be made. Namely, it is possible to make hall calls have different priorities, even though they are generated in the same preferential zone; for example, hall calls which are generated in floors near the cage, are made to have higher or lower priorities, compared with those generated in floors far from the cage.

As described above, since the evaluation index WT of the waiting time is combined with the evaluation index $Z_p$ with the control parameter $k_p$ functioning as a weight coefficient, the string-of-cages operation can be eliminated by selecting the control parameter $k_p$ at an appropriate value, with the result that the average waiting time and the rate of long-waiting are much improved.

Figure 20:
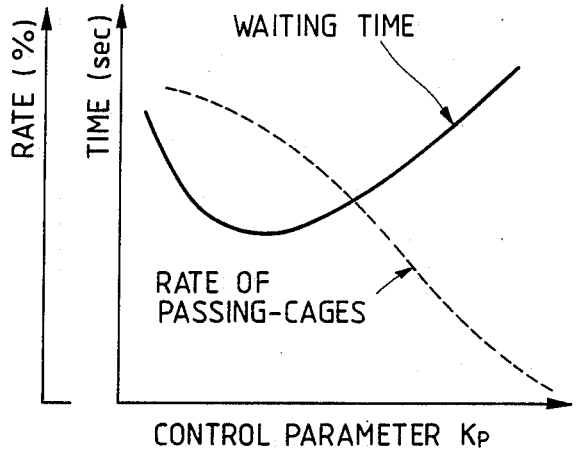
FIG. 20 is a graph showing the relation of the waiting time and the rate of passing-by cages with respect to control parameter $k_p$ according to the inventor's simulation.

Further, as already described, as the control parameter $k_p$ becomes large, the influence of the evaluation index $Z_p$ of the preferential zone on the call allotment becomes relatively large, compared with that of evaluation index WT of the waiting time. As a result, the effect of the preferential zone appears more intensively, whereby the number of the cages passing by a hall call floor are reduced. According to the inventor's simulation, the relations of the waiting time and the rate of passing-by cages with respect to the control parameter $k_p$ were as shown in FIG. 20, which suggests that the rate of passing-by cages can be controlled by the control parameter $k_p$.

(B) Algorithm for controlling the rate of long-waiting

The rate of long-waiting greatly depends on the algorithm for controlling the waiting time. If the average waiting time becomes shorter, the rate of long-waiting depending thereon tends to become smaller, too. In the present embodiment, therefore, the algorithm already known, for example, by the laid-open Japanese patent application No. JP-A-52-11554 (1977) is employed. Namely, this algorithm is expressed in the form of the following production rule.

If "(a waiting time of an already allotted hall call) $\geqq$ $TH_1$", then "alter the allotment of the hall call to a first-arriving cage" (9)

In the formula above, $TH_1$ is a threshold for a waiting time in the long-waiting, which is determined as follows. As already described, the control target $x_2$ for the rate of long-waiting is determined in accordance with the individual function $f_2(x_2)$ on the basis of the feeling target $S_2$ set by an operator. Further, a certain characteristic curve of the threshold $TH_1$ with respect to the control target $x_2$ is provided in advance on the basis of the past experience of the service operation of an elevator system in a building of the similar manner of use. The characteristic curve, however, is gradually improved so as to adapt the manner of use of a corresponding building by means of the learning function, which will be described later. Therefore, the threshold $TH_1$ can be determined by the operator's setting of the feeling target $S_2$ for the rate of long-waiting.

According to this algorithm, when the condition of the if-clause of the formula (9) is satisfied, the allotment of an already allotted hall call is altered to a first-arriving cage. In this case, the re-allotment of a hall call is carried out in accordance with the algorithm of the formula (6), again.

As an aside, it is to be noted that there is the following relation between the threshold $TH_1$ and the rate of changing a reserved cage, which will be described in detail later. Namely, the former is made smaller, the latter necessarily becomes large, and vice versa.

(C) Algorithm for controlling the riding time

The riding time $t_c$ is expressed by the following formula.

tc = (an elapsed time from the registration of a cage call to the present time) + (a time from the present time to the arrival of the cage at a cage call floor) (10)

There is often the case where the plural cage calls exist simultaneously. In the present embodiment, therefore, an evaluation index $T_c$ for the riding time is approximated by the following formula.

$$T_c = \max\{t_{cm}\} \quad (11)$$

$m = 1, 2, \ldots, M$

In the formula above, M denotes the total number of cage calls, which exist at that time. Therefore, $t_{c1}, t_{c2}, \ldots, t_{cM}$ indicate the riding times calculated concerning the cage calls $c_1, c_2, \ldots, c_M$, which exist at that time. Further, it is of course possible to use an average value of $t_{c1}, t_{c2}, \ldots, t_{cM}$ or the whole sum of squares thereof as the evaluation index $T_c$, instead of the value obtained by the formula (11) above.

If the evaluation index $T_c$ is taken as one of the indexes evaluating the overall operation condition of cages, the formula (6) is further corrected as follows:

$$\phi_n = (WT - k_p z_p + k_c t_c)_n \quad (12)$$

$n = 1, 2, \ldots, N$ wherein $k_c$ is a control parameter, which functions as a weight coefficient for the evaluation index of the riding time. Similarly to the case of the already described formulas, a hall call is allotted to a cage having the minimal one of the evaluation values $\phi_n$ calculated in accordance with the formula (12) above.

As indicated in the formula (12), the component relating to this control item is incorporated in the evaluation function with the plus sign. Accordingly, if the evaluation index $T_c$ is large, the evaluation value calculated by the formula (12) becomes large, too, and therefore a hall call becomes difficult to be allotted to a cage having such a large evaluation index $T_c$. Since, however, a cage having a large evaluation index $T_c$ has a passenger therein, who wants the long range traveling, it is rather convenient to make the call allotment to such cage difficult and not to respond to hall calls generated within the scope of the short range traveling.

(D) Algorithm for controlling the cage-load factor

For the purpose of controlling the cage-load factor, it is necessary to estimate the number of passengers within a cage at every floor by using the number of persons waiting in an elevator hall and the present number of passengers within the cage.

The number of waiting persons can be learned, for example, by an image processing technique already known, according to which a television camera takes an image of persons waiting in an elevator hall and the taken image is processed. The number of waiting persons can be roughly estimated on the basis of the processed image. The present number of passengers can be detected by a load sensor, which is usually installed in an elevator cage.

For estimation of the number of passengers, the method, which is described in the laid-open Japanese patent application No. JP-A-52/47249 (1977), for example, can be adopted also in the present embodiment. The aforesaid prediction method is briefly described, referring to FIG. 21.

In the figure, it is assumed that cage A travels upward with five passengers and cage B travels downward with ten passengers. A black circle means a cage call generated in the cage A, and therefore, it means that there is a passenger in the cage A who wants to get off at a floor represented by the black circle. Black triangles means hall calls, which have been already allotted to the cage A or B, respectively. The hall calls allotted to the cage A are put on the closed touring loop of the cage A. The same is applied to the hall call allotted to the cage B. The triangle also indicates the traveling direction. A white triangle means a hall call, which is just generated and not yet allotted to any cage.

Numerals accompanying the respective calls represent the number of persons which get in or off corresponding cages. The numeral with the plus sign represents the number of persons getting in a cage and that with the minus sign the number of persons getting off a cage. Further, numerals within parentheses represent the present number of passengers within a cage at respective floors. Therefore, the number of passengers of a cage at every floor can be learned by carrying out the calculation on the basis of the numerical values as mentioned above.

Figure 21:
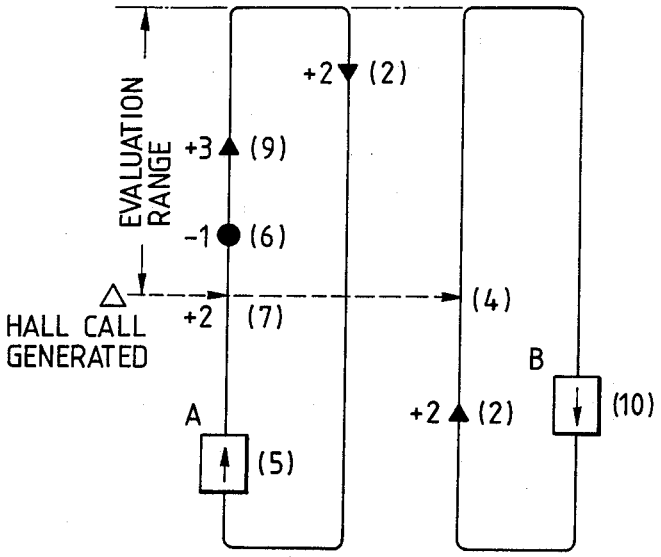
FIG. 21 is a drawing for explaining a method of estimating the number of passengers within a cage at every floor for the purpose of controlling the load-factor of a cage.

The prediction or estimation of the number of passengers at every floor is carried out with respect to the floor range from a hall call floor to an end floor (uppermost floor or lowermost floor), as shown as an evaluation range in FIG. 21. On the basis of the thus estimated number of passengers at every floor, the evaluation index of the cage-load factor is obtained by any of the following schemes.

a. Minimal cage-load factor scheme:

The number of passengers within a cage is estimated at every floor within the evaluation range. The minimal one among the estimated number of passengers is selected, and the selected number of passengers is used for obtaining the evaluation index.

b. Maximal cage-load factor scheme:

The number of passengers within a cage is estimated at every floor within the evaluation range. The maximal one among the estimated number of passengers is selected, and the selected number of passengers is used for obtaining the evaluation index.

c. Minimal deviation scheme:

There is obtained at every floor within the evaluation range the difference between the estimated number of passengers and a predetermined value. The minimal one among the thus obtained differences is selected, and the selected number of passengers is used for obtaining the evaluation index.

d. Psychological irritation scheme:

There is obtained the sum of squares of the numbers of passengers estimated for floors within the evaluation range, which is used for obtaining the evaluation index.

An evaluation index of the cage-load factor is determined as a ratio of the value obtained in accordance with any of the aforesaid schemes to a capacity of a cage. Assuming that this index is indicated by $L_L$, the formula (12) is further corrected, as follows:

$$\phi_n = (WT - k_p Z_p + k_L L_L)_n \quad (13)$$

$n = 1, 2, \ldots, N$ wherein kL is a control parameter, which functions as a weight coefficient of the evaluation index of the cage-load factor. Similarly to the foregoing, a hall call is allotted to a cage having the minimal one of the evaluation values $\phi_n$ calculated in accordance with the formula (13) above.

In the manner described above, since the evaluation index $L_L$ of the cage-load factor is incorporated in the evaluation function in the present embodiment, the load of a cage can be controlled so as to be maintained at a desired value on an average. Accordingly, there can be avoided the condition that cages are often full, and therefore the number of cages, which have to pass through a hall call floor due to full cage, can be greatly decreased.

(E) Algorithm for controlling the rate of changing a reserved cage

Changing of a reserved cage (reservation change) occurs, when a hall call, which has already been allotted to a certain cage, is changed to be allotted to another cage because of occurrence of full cage or long-waiting in the certain cage. Similarly to the algorithm for controlling the long-waiting, this algorithm is expressed as follows.

If "(the ratio of the number of passengers of a reserved cage to the capacity of the cage) $\geqq TH_2$", then "change the allotment of the hall call of the cage to another cage, which has the smaller predicted number of passengers." (14)

In the formula above, $TH_2$ is a threshold, which is variable in accordance with the cage-load factor, and which is provided by the individualizing function $f_5(x_5)$ shown in FIG. 10 on the basis of the feeling target S5 given by an operator. As apparent from the above, the rate of changing a reserved cage can be easily controlled by only adjusting the threshold $TH_2$. Further, the reallotment of the call can be carried out by using the formula (6), (12) or (13).

(F) Algorithm for controlling the information time of a reserved cage

According to this algorithm, the time from registration of a hall call to announcement of a reserved cage for the hall call can be controlled by a variable threshold $TH_3$. Further, even during this time, the allotment of the hall call is reviewed at appropriate intervals, e.g., 1 to 5 sec.. The reviewal of allotment of the hall call is carried out in accordance with the evaluation function as already described by the formula (6), (12) or (13). Assuming that a hall call is generated in a certain floor at time point $t_0$, this algorithm is expressed as follows.

If "$(t_g - t_o) \leqq TH_3$", then "allot the hall call to an adaptive cage evaluated at time point tg," else "inform waiting persons in the floor of a reserved cage based on the evaluation at time point $t_{g-1}$." (15)

In the formula above, $t_g$ represents the present time point and $t_{g-1}$ the time point preceding $t_g$ by one allotment reviewing interval, and therefore $t_g = t_0$ at the time of generation of the hall call. The threshold $TH_3$ is provided by the individualizing function $f_6(\times_6)$ shown in FIG. 10 on the basis of the feeling target $S_6$ given by an operator.

As apparent from the above, the information time of a reserved cage can be easily altered by adjusting the threshold $TH_3$. Of course, the allotment of hall call in the algorithm of the formula (15) is achieved by using the evaluation function expressed by the formula (6), (12) or (13).

(G) Algorithm for controlling the transportation capacity

Although various methods of controlling the transportation capacity have been considered, the method of controlling the number of available cages is employed in the present embodiment. If, for example, an elevator hall of a specific floor is very crowed, i.e., there is a large traffic demand in the specific floor, the number of cages available for serving the specific floor is increased. Therefore, this algorithm is expressed as follows.

If "(the number of cages available for the crowed floor) $\leqq TH_4$", then "increase the number of cages capable of serving the floor." (16)

In the formula above, $TH_4$ is a threshold, which is provided by the individualizing function $f_7(\times_7)$ shown in FIG. 10 on the basis of the feeling target $S_7$ given by an operator.

Therefore, if the judgment condition in the formula above is satisfied, hall calls generated at the crowded floor are allotted to other cages, too, in addition to a cage, to which a hall call generated at the floor is to be allotted under the usual condition. In this manner, the transportation capacity can be easily adjusted by altering the threshold $TH_4$. Further, the additional allotment of hall calls to other cages can be carried out in accordance with the evaluation function expressed by the formula (6), (12) or (13) described above.

(H) Algorithm for controlling the rate of first arriving cages

Figure 22:
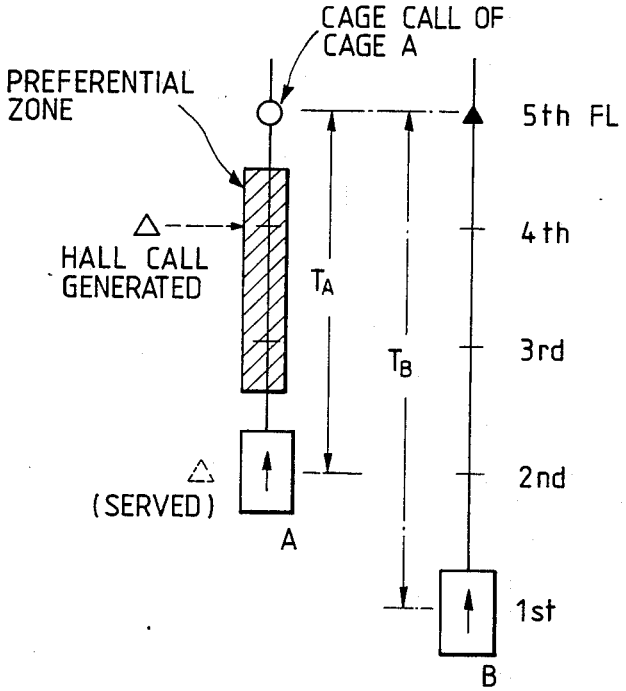
FIG. 22 is a drawing for explaining the concept of a first-arriving cage preferential zone and the establishment thereof.

As already described, the rate of first-arriving cages means a rate of cages, which can arrive at a hall call floor earlier than a reserved cage. In FIG. 22, for example, there is the case where cage A arrives at the fifth floor earlier than cage B, not withstanding a hall call generated at the fifth floor has already been allotted to the cage B. In this case, the cage A is a first-arriving cage and the cage B is a reserved cage, with respect to the hall call generated at the fifth floor. The first-arriving of the cage A as mentioned above occurs because of a cage call generated therein.

The possibility of occurrence of a first-arriving cage can be learned by calculating times $T_A$ and $T_B$ necessary for the respective cages A and B to travel to the fifth floor and watching which is longer. The calculation and comparison of the times $T_A$ and $T_B$ are carried out at appropriate intervals. If it is founded that $T_A$ is smaller than $T_B$, this suggests the possibility of occurrence of the first-arriving cage.

Then, the concept of a first-arriving cage preferential zone is introduced. Namely, the first-arriving cage preferential zone is established in accordance with the following production rule.

If "a cage call floor of a cage agrees with a hall call floor of another cage and the cage is predicted to be a first-arriving cage", then "establish a first-arriving cage preferential zone for the cage between of a present position of the cage and the cage call floor." (17)

The thus established pruferential zone is taken into consideration in the evaluation function. If an evaluation index of the first-arriving preferential zone is indicated by $Z_z$, which assumes the value of 1.0 for a hall call within the preferential zone and otherwise, the value of 0, the evaluation function can be expressed, as follows;

$$\phi_n = (WT - k_pZ_p + k_cT_c + k_LL_L - k_zZ_z)_n \quad (18)$$

$n = 1, 2, \ldots, N$ wherein $k_z$ is a control paraxeter, which functions as a weight coefficient of the evaluation index of the first-arriving preferential zone.

Similarly to the case of the formulas (6), (12) and (13), a hall call is allotted to a cage having the minimal one of the evaluation values $\phi_n$ calculated in accordance with the formula (18) above. With this algorithm, the arrival time of a predicted first-arriving cage can be delayed and the occurrence of a first-arriving cage is prevented. Therefore, the rate of first-arriving cages can be decreased.

In the formula (18), the component $k_zZ_z$ has been incorporated in the evaluation function with the minus sign, whereby the value within parentheses decreases as a whole so that a hall call is facilitated to be allotted to a first-arriving cage. On the contrary, the following is also possible. Namely, particular zones for cages other than the cage, which generates a cage call, are established between present positions of the respective other cages and a cage call floor, and the formula (18) is modified so as to incorporate the component $k_zZ_z$ therein with the plus sign. In this case, a hall call generated within the particular zones is made difficult to be allotted to the other cages, and resultantly easy to be allotted to a first-arriving cage. In this sense, the particular zones can be called penalty zones.

(I) Algorithm for controlling the number of passing-by cages

This controls the operation of other cages not to pass by a reserved cage, to which a hall call has been allotted, before the reserved cage serves the hall call.

This control can be achieved by controlling the control parameter $k_p$ already referred to in the description of the algorithm for controlling the waiting time. Namely, if the value cf the parameter $k_p$ is made large, the effect of the equal time-interval operation control is enhanced so that the number of the passing-by cages are reduced. Therefore, the algorithm for controlling the waiting time is also available for this algorithm with the control parameter $k_p$ controlled.

The relation of the rate of passing-by cages to the control parameter $k_p$ is as shown in FIG. 20. As apparent from the figure, the rate of passing-by cages becomes small, as the control parameter $k_p$ is made large. Contrarily, however, the waiting time becomes large with the control parameter $k_p$. Therefore, the control parameter $k_p$ must be selected at an appropriate value in view of the manner of use of a building.

(J) Algorithm for controlling the amount of general information

This algorithm controls the amount of general information to be announced, such as information about events taking place in a building, weather forecast, time, news, etc. in addition to the state of the call allotment. As already described, the amount of information is expressed by the product of the number of kinds of information to be announced and the number of times of announcement. The information: can be classified into the following levels, for example.

Level 1 (corresponding to 20 in the feeling target)

An information, such as a present position of cages, the waiting time, the degree of crowdedness of a cage, is visually or aurally announced in an elevator hall. The control target of $x_{10} = 3$ is assigned to this level, for example.

Level 2 (corresponding to 40 in the feeling target)

An information, such as present time and weather forecast, is visually or aurally announced, in addition to the information of the level 1. The control target of $x_{10} = 5$ assigned to this level, for example.

Level 3 (corresponding to 60 in the feeling target)

Today's big news is visually or aurally announced, in addition to the information of the level 2. The control target of $x_{10} = 6$ is assigned to this level, for example.

Level 4 (corresponding to 80 in the feeling target)

An information of events taking place in a building is visually or aurally announced, in addition to the information of the level 3. The control target of $x_{10} = 7$ is assigned to this level, for example.

Level 5 (corresponding to 100 in the feeling target)

An information, such as today's menu of lunch in restaurants in a building, a stock market information, and time schedules of railway, subway, etc., is visually or aurally announced, in addition to the information of the level 4. The control target of $x_{10} = 9$ is assigned to this level, for example.

Usually, as in the example described above, the levels of the announcement of the information is classified in such a manner that the amount of information is given to persons waiting elevator halls with higher level of information. With this leveling, the amount of information to be announced can be easily controlled. Further, it can be considered that when the same content of information is repeatedly announced, the number of repetition times of announcement is changed so as to become large as the level of information is high.

Anyway, the manner itself of classification of information to be announced is absolutely arbitrary, and the kinds of information to be announced and the classification thereof can be determined in response to the manner of use of a building or some other reasons. This algorithm can be linked with the selection of the variations of the individualizing function $f_1(x_1)$ as described with reference to FIG. 11*a*.

(K) Algorithm for controlling the rate of saving consumed electric power

It is well known that the electric power consumed by an elevator system greatly depends on the number of times of start and stop of elevator cages. For the purpose of controlling the rate of saving consumed electric power, the following method was heretofore carried out, for example:

a. to control the number of cages available for service; and b. to evaluate a stop call in the neighbor of a hall call and allot the hall call to a cage having the stop call, whereby the number of times of start or stop of cages can be totally reduced.

In the present embodiment, the method b. mentioned above is employed. If an index of evaluating a stop call is indicated by $Z_s$, which assumes the value of 1.0 if a floor of a stop call agrees with a hall call floor, and otherwise, the value of 0, the evaluation function is further corrected, as follows:

$$\phi_n = (WT - k_pZ_p + k_cT_c + k_LL_L - k_zZ_z - k_sZ_s)_n \quad (19)$$

$$n = 1, 2 \ldots, N$$

wherein $k_s$ is a control parameter, which functions as weight coefficient for the control of saving the consumption of the electric power.

Further, since the parameter $k_s$ can assume a continuous value, the component $k_sZ_s$ can be incorporated in the evaluation function as a continuous variable. This means that also the rate of saving the consumed electric power can be controlled continuously.

(2) Summary of the aforesaid algorithm the function and operation of the functional 1D

In the foregoing, the algorithms controlling the respective control items have been described. To sum up, the control algorithms for the control items of the rate of long-waiting, the rate of changing a reserved cage, the time of information of a reserved cage and the transportation capacity are described in the form of the production rules of the formulas (9), (14), (15) and (16), respectively.

The control algorithms for the control items of the waiting time taking account of the equal interval operation, the riding time, the cage-load factor, the rate of first-arriving cages and the rate of saving consumed electric power are included in the evaluation function expressed by the formula (19).

Moreover, although the formula (19) is referred to in the above, either one selected from among the formulas (6), (12), (13) and (18) can be also employed instead of the formula (19). However, the use of such formula is equivalent to the fact that the control parameters $k_c$, $k_L$, $k_z$ and $k_s$ in the formula (19) are selectively set at zero. Namely, if the formula (19) is adopted, the form of the evaluation function can be arbitrarily altered only by the selection of values of those control parameters. In the following therefore, the description will be made of the case, wherein the formula (19) is employed.

Since also the thresholds $TH_1$ to $TH_4$ in the formulas (9), (14), (15) and (16) can be regarded as a kind of control parameter, a parameter included in all the aforesaid formulas is generally expressed in the following form.

$$= \{TH_1, TH_2, TH_3, TH_4, k_p, k_c, k_L, k_z, k_s\} \quad (20)$$

As already described, the respective parameters $TH_1$, $TH_2$, $TH_3$, $TH_4$, $k_p$, $k_c$, $k_L$, $K_z$, $k_s$ can assume several desired values in response to the feeling targets supplied by an operator. Therefore, a control parameter $\mathbb{P}$ can be expressed in the general form, as follows:

$$\mathbb{P}_j = \{P_{1j}, P_{2j}, \ldots, P_{Uj}\} \quad (21)$$

wherein $P_1, P_2, \ldots, P_U$ mean the various kinds of control parameters, such as the thresholds $TH_1$ to $TH_4$ and the control parameters $k_p$, $k_c$, etc., as mentioned above, and j assumes 1, 2, . . . , J, in which J denotes the number of variations of a control parameter.

Further, in the algorithms for controlling the waiting time and the cage-load factor, there have been prepared some kinds of schemes for the respective algorithms. Namely, in the algorithm for controlling the waiting time, there have been prepared four kinds of schemes a to d of the algorithm for evaluating the waiting time. In the same algorithm, for the establishment of the equal time-interval preferential zone, there are prepared three kinds of schemes a to c of the algorithm for determining the dummy direction and also three kinds of schemes a to c of the algorithm for determining a first-starting cage. Further, in the algorithm for controlling the cage-load factor, there are provided four kinds of schemes a to d.

In such a case as mentioned above, an algorithm to be prepared can be generally expressed, as follows:

$$\mathbb{A}_j = \{A_{1j}, A_{2j}, \ldots, A_{mj}\} \quad (22)$$

wherein $A_1, A_2, \ldots$, or $A_M$ means different kinds of algorithm as expressed by the formulas as already mentioned, and similarly to a case of the formula (21), j assumes 1, 2, . . . , J, in which J denotes the number of variations of an algorithm.

Figure 24B:
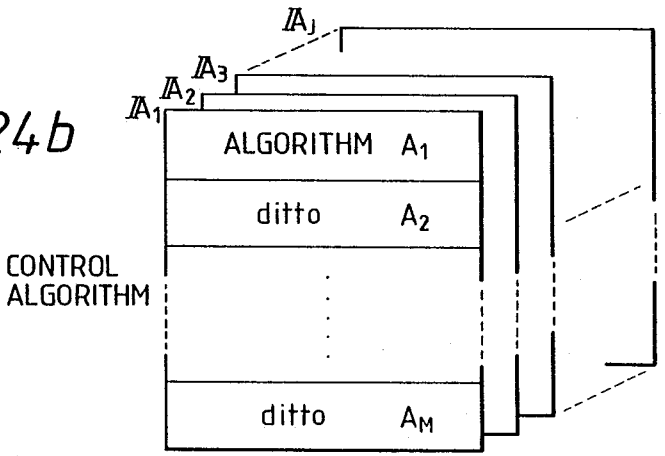
FIGS. 24*a* to 24*c* show examples of data-base, which are stored in the appropriate area provided in a storage of the processor $M_1$ and used for the processing operation in the individualizing support part shown in FIG. 5.
Figure 24C:
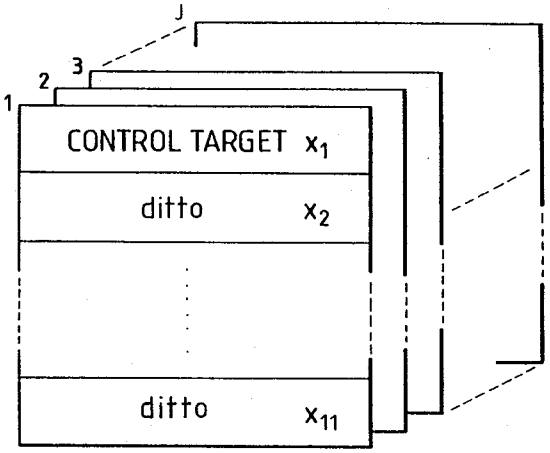
Figure 24A:
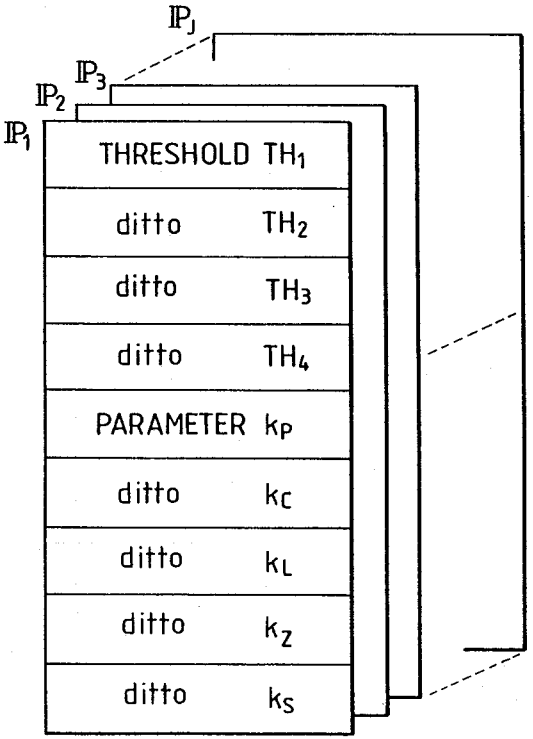

Referring again to FIG. 13, the aforesaid $\mathbb{P}_j$ and $\mathbb{A}_j$ are held in the functional block 1Dd. Namely, they are stored in a particular area d<fined in RAM of the processor $M_1$ as data-base of knowledge for inference of a control method and parameters in the form as shown in FIGS. 24*a* and 24*b*. The functional block 1Dc executes the inference for selecting adaptive ones from among $\mathbb{P}_j$ and $\mathbb{A}_j$. This inference is carried out in the following production rules, which are also stored in the block 1Dd as data-base.

| | |
|---|---|
| RULE D-1: | If "$(x_1, x_2, \ldots, x_{11})_1$ and actual data $u_1$", then $(\mathbb{P}_1, \mathbb{A}_1)$ |
| RULE D-2: | If "$(x_1, x_2, \ldots, x_{11})_2$ and actual data $u_2$", then $(\mathbb{P}_2, \mathbb{A}_2)$ |
| . | |
| . | |
| . | |
| RULE D-J: | If "$(x_1, x_2, \ldots, x_{11})_J$ and actual data $u_J$", then $(\mathbb{P}_J, \mathbb{A}_J)$ |

These rules can be prepared in advance by carrying out the simulation on the off-line basis and stored by the functional block 1Dd as data-base. Although this simulation is carried out under the various variations of the control targets and the actual data, also the variations of the control targets $(x_1, x_2, \ldots, x_{11})_1$ to $(x_1, x_2 \ldots, x_{11})_J$ used for the simulation are stored by the functional block 1Dd an data-base in the form as shown in FIG. 24*c*. Further, although the actual data is given for this simulation in the form of the traffic demand pattern, they will be described in detail later.

The functional block 1Dc is supplied with the control targets $x_1$ to $x_{11}$ from the functional block 1Da and the actual data $u_1$ to $u_J$ from the functional block 1Db, and executes the inference in accordance with the production rules as described above. Namely, the functional block 1Dc retrieves a rule having the condition, which agrees with the supplied control targets $x_1$ to $x_1$ and the actual data $u_1$ to $u_J$ and produces the parameters $\mathbb{P}_j$ and the algorithm $\mathbb{A}_j$ corresponding thereto. As a result, adaptive parameters and algorithm are selected from among the above $\mathbb{P}_j$ and $\mathbb{A}_j$. The functional block 1De holds the thus selected $\mathbb{P}_j$ and $\mathbb{A}_j$ temporarily. Then, they are produced as the output of the functional block 1D through the line c.

3.1.3 Simulation (1E)

Figure 25:
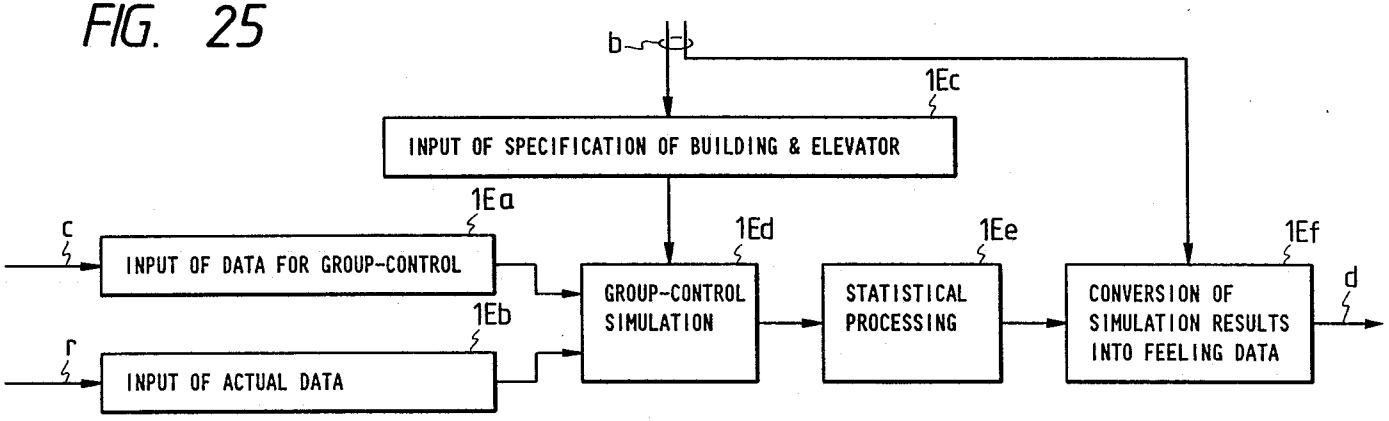
FIG. 25 is a functional block diagram showing the detailed configuration of the function of simulation (block 1E) included in the individualizing support part of the overall functional block diagram of FIG. 5.

Referring next to FIG. 25, the explanation will be made of the functional block 1E, i.e., the simulation. This simulation is carried out in order to learn what degree of effect can be expected by means of the targets of the control items selected and set by an operator under the condition of the then present traffic demand. This functional block 1E, as disclosed in the laid-open Japanese patent application No. JP-A-58/63663 (1983), for example, comprises the following subordinate functional blocks.

Namely, there are provided three input functional blocks, i.e., input 1Ea of the data for the group-control, which is supplied from the functional block 1D (FIG. 13) in the form of the selected ones of $\mathbb{P}_j$ and $\mathbb{A}_j$ through the line c, input 1Ed of the actual data, which is provided from the group-control part through the line r, input 1Ec of specification of a building and an elevator system, which is supplied by the functional block 1C (FIG. 6) through the line b.

There is further provided group-control simulation 1Ed, which receives three inputs as mentioned above and carries out the simulation of the control parameters and algorithms supplied from the functional block 1Ea on the basis of the actual data of the traffic demand supplied from the functional block 1Eb and the specification of the building and the elevator supplied from the functional block 1Ec. Results of this simulation are transmitted to functional block 1Ee, in which the simulation result is subject to the predetermined statistical processing.

The statistically processed simulation results are coupled to functional block 1Ef, in which the simulation results are converted into data in terms of the feeling. This conversion can be carried out by using the individualizing functions, which are supplied from the functional block 1Cd through the line b. Namely, the simulation results can be converted into the data in the form of the feeling by carrying out the reversal of the conversion as shown in FIG. 12.

Further, to simplify the configuration of the individualizing support part, the function 1E for the simulation can be omitted. In that case, there can be obtained only the predicted results of the parameters $\mathbb{P}_j$ and the algorithms $\mathbb{A}_j$ based on the actual data, which have been obtained during the past service operation.

3.1.4 Evaluation and control execution (1F)

Figure 26:
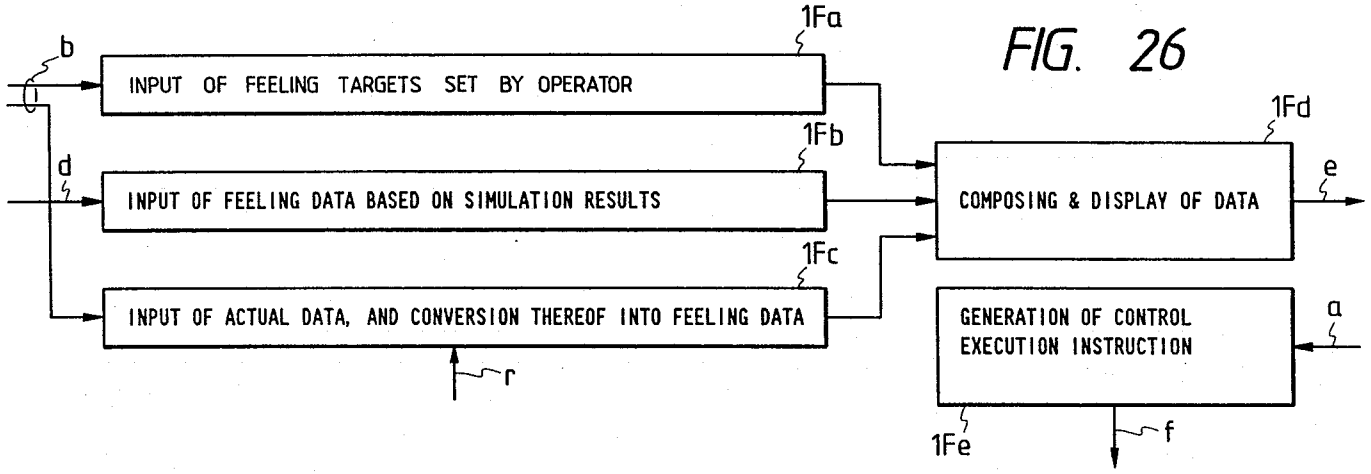
FIG. 26 is a functional block diagram showing the detailed configuration of the function of evaluation (block 1F) included in the individualizing support part of the overall functional block diagram of FIG. 5.

The configuration of this functional block 1F is shown in FIG. 26. This block 1F comprises three input functions, as follows, i.e., input 1Fa of data of the feeling targets from the functional block 1Ca through the line b, which are set by an operator, input 1Fb of the feeling data converted from the simulation results by the functional block 1Ef through the line d, and input 1Fc of actual data and conversion thereof into feeling data. Further, in an analogous manner to the functional block 1Ef, there are taken in the block 1Fc the individualizing functions from the functional block 1Cd through the line b in order to convert the actual data taken therein, which are supplied from the group-control part through the line r and expressed in terms of the physical quantities, into data in terms of the feeling.

Figure 23:
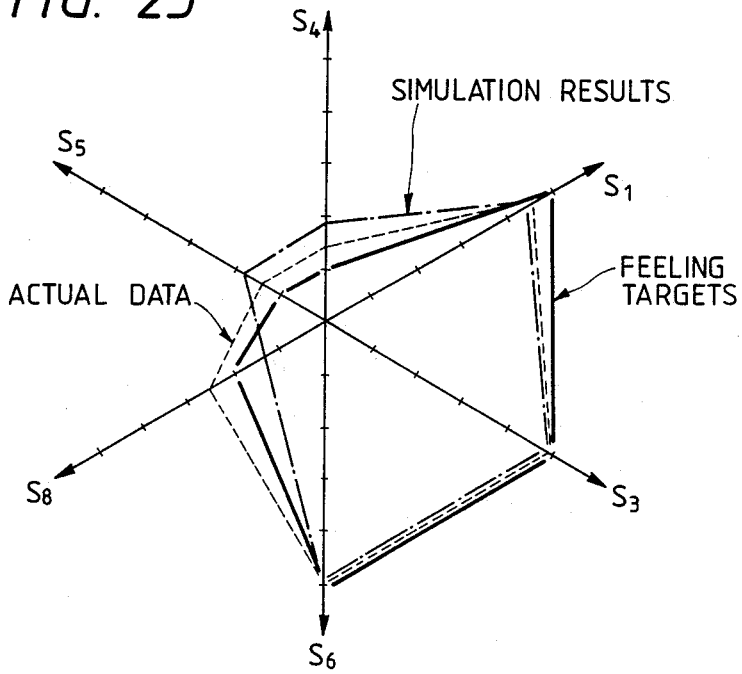
FIG. 23 is a radar chart, in which three kinds of data are shown simultaneously with respect to the six control items.

The three input data as mentioned above are coupled to a functional block 1Fd, in which they are composed to form a display data, which is outputted to the display device DD. An example of the display is shown in FIG. 23. In the case shown, three kinds of data, which are, as described above, supplied through the respective functional blocks 1Fa, 1Fb, 1Fc, are displayed simultaneously on a single radar chart, whereby the three data can be easily compared to facilitate the judgment of the appropriateness of the feeling targets set by an operator. However, it is of course that the three kinds of data can be displayed on separate radar charts.

This functional block 1F further includes subordinate functional block 1Fe, i.e., the generation of a control execution instruction. When an operator observes the data displayed on the display device DD and gives an approval signal to this block 1Fe by the input device ID, this block 1Fe produces a control execution instruction to the group-control part through the line f.

3.2 Group-control part

As already described, this part carries out the group-control of the plural elevator cages in accordance with the algorithms determined in the individualizing support part described above on the basis of cage calls generated in the respective cages and hall calls generated by the hall call device HC. As shown in FIG. 5, this part comprises the following functional blocks, i.e., program registration 2A, store 2B of actual data and group-control 2C. In the following, details of the respective functional blocks will be described.

3.2.1 Program registration (2A)

Figure 27:
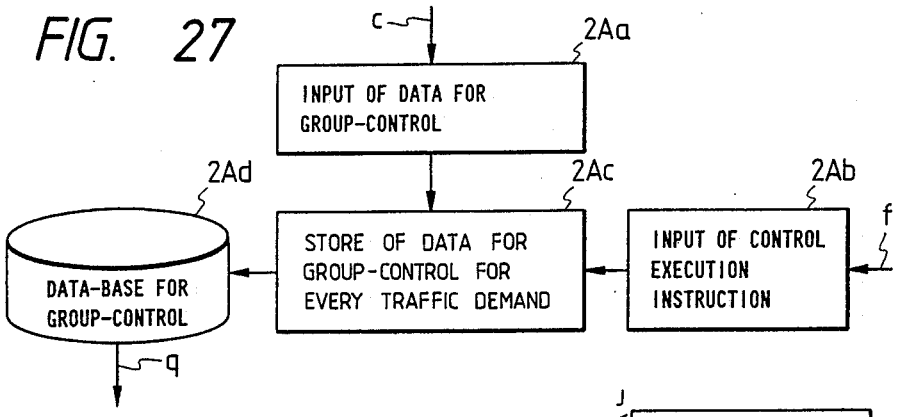
FIG. 27 is a functional block diagram showing the detailed configuration of the function of program registration (block 2A) included in the group-control part of the overall functional block diagram of FIG. 5.

Referring to FIG. 27, there is shown the configuration of the functional block 2A of program registration. As shown in the fig., this block 2A is composed of the following subordinate functional blocks, i.e., input 2Aa of data for group-control, input 2Ab of the control execution instruction, store 2Ac of data for group-control according to a traffic demand, and database 2Ad for group-control.

The data $\mathbb{P}_j$ and $\mathbb{A}_j$ for group-control, which are supplied from the functional block 1De, are given through the functional block 2Aa to this functional block 2A. Also the control execution instruction, which is issued by the functional block 1Fe is taken in this functional block 2A through the functional block 2Ab. When the control execution instruction is taken into the functional block 2A, the data $\mathbb{P}_j$ and $\mathbb{A}_j$ for group-control given through the functional block 2Aa are stored in the functional block 2Ac, temporarily. These data can be stored for every traffic demand pattern or for every time zone. The data $\mathbb{P}_j$ and $\mathbb{A}_j$ are transmitted and held in the functional block 2Ad as data-base for the group-control.

3.2.2 Store of actual data (2B)

This function can be achieved by a known function as disclosed, for example, in the article "Development of Elevator Supervisory Group Control System with Artificial Intelligence", by Yoshio Sakai et al, "Hitachi Hyoron (Review)", Vol. 65, No. 6 (1983), pp. 43 to 48. According thereto, during the daily service operation of an elevator system, the number of persons using the elevator is estimated at every floors and in every traveling direction on the basis of the change of the cage load, the state of registered cage calls and hall calls and so on, which are supplied from the functional block 2C described later, and data of the actual traffic flow are collected.

Figure 28:
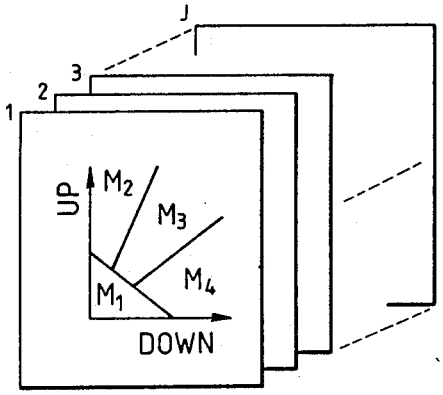
FIG. 28 shows an example of actual data, which are stored in an appropriate storage of the processor M2 in the form of traffic demand pattern.

On the basis of the collected data of the traffic flow, a traffic demand pattern is formed for every time zone. An example of the traffic demand pattern is shown in FIG. 28, in which the traffic demand patterns $M_1$, $M_2$, $M_3$ and $M_4$ are defined in accordance with the downward traffic demand (abscissa) and the upward traffic demand (ordinate). The thus formed traffic demand patterns are stored by this functional block 2B.

The traffic demand patterns are renewable on the basis of new actual data collected during the daily service operation, which are supplied by the functional block 2C, i.e., the group-control. With this function, therefore, the group-control of the elevator system is furnished with a so-called learning effect.

3.2.3 Group-control (2C)

Figure 29:
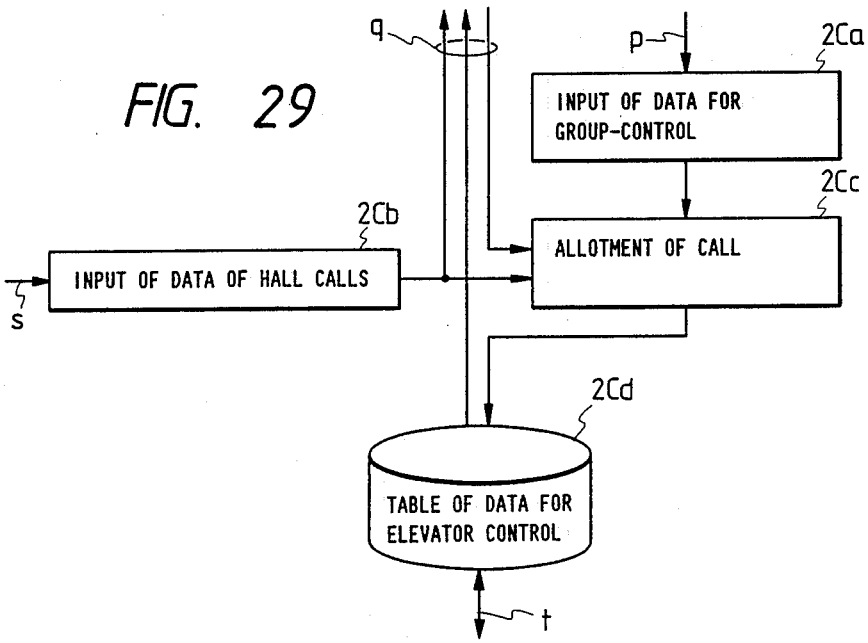
FIG. 29 is a functional block diagram showing the detailed configuration of the function of group-control (block 2C) included in the group-control part of the overall functional block diagram of FIG. 5.

The configuration of this block 2C is shown in FIG. 29. The block 2C comprises the following subordinate functional blocks, i.e., input 2Ca of data for groupcontrol, input 2Cb of data of hall calls, allotment 2Cc of a call and table 2Cd of data for the group-control.

When a hall call is generated by the hall call device HC, it is inputted to the functional block 2Cc by the functional block 2Cb. Further, the functional block 2Cc takes therein the data of the traffic demand pattern from the functional block 2B through the line q and the data $\mathbb{P}_j$ and $\mathbb{A}_j$ for group-control, i.e., the parameters and the algorithms, from the functional block 2Ad by the functional block 2Ca. In the functional block 2Cc, the necessary processing is carried out in accordance with the supplied parameters $_j$ and the algorithms $\mathbb{A}_j$ on the basis of a hall call supplied by the functional block 2Cb, and accordingly the hall call is allotted to an adaptive cage.

The result of allotment by the functional block 2Cc is stored in the table 2Cd of data for the group-control. The data is set to one of the processors $E_1$ to $E_N$ for controlling the service operation of the respective cages, which corresponds to the aforesaid adaptive cage, from this table 2Cd through the line t. In response to the allotted hall call, the one processor controls the service operation of the corresponding cage.

3.2.4 Miscellaneous

The group-control part as described above can be further attached by a simulation function, by which the control parameters $\mathbb{P}_j$ is automatically adjusted on the basis of the actual data. Such a function is achieved by the same as the simulation function 1F described in the paragraph 3.1.3. With this, the fine tuning of the control parameters $\mathbb{P}_j$ becomes possible.

4 Modification and variation

In the following, the explanation will be made of the modification and variation of the embodiment described above. As already described, in the data-base 1Dd of knowledge for the inference of a control method and control parameters, a very large amount of data of the control targets $(x_1, x_2, \ldots, x_{11})_j$ and the actual data $u_j$ have to be stored, and therefore the number of the production rules becomes very large, too.

The functional block 1Dd receives the plural control targets $(x_1, x_2, \ldots, x_{11})_j$ and the actual data $u_j$ and determines the control parameters $_j$ and the control algorithm $_j$ in accordance with predetermined rules. However, the behaviour of elevator cages under the operation is very complicated and therefore can not be expressed by a model described by a distinct mathematical formula or formulas, with the result that it is very difficult to formulate the predetermined rules.

Then, usually, the rules have been gotten by means of the statistical processing of the result, which is obtained by simulating the actual service operation of the elevator cages. If, however, the number of the control items to be considered increases, some of them are related to each other in the complicated manner and it becomes difficult more and more to get the rules.

In the following, there will be described a method of reducing the amount of data necessary in the functional block 1Dd and a method of easily acquiring the database on the basis of such data.

To facilitate the understanding, only three control targets, i.e., the waiting time $x_1$ taking account of the equal time-interval preferential zone $Z_p$, the cage-load factor $x_4$ and the rate of first-arriving cages $x_8$, are considered. The control target values actually set are represented by $\bar{x}_1$, $\bar{x}_4$ and $\bar{x}_8$, respectively. In such a case, the evaluation function is expressed by the following formula.

$$\phi_n = (WT - k_p Z_p + k_L L_L - k_z L_z)_n \tag{23}$$

$$n = 1, 2, \ldots, N$$

In the same manner as already described, when a hall call is generated, the evaluation values $\phi_n$ are calculated with respect to all of group-controlled cages, and the hall call is allotted to a cage, which has the smallest value of $\phi_n$. Further, it is assumed that there is in this case no variations of the control parameters $\mathbb{P}_j$ and the algorithms $\mathbb{A}_j$ expressed in the formulas (21) and (22). Therefore, only one set of the control parameters $k_p$, $k_L$, $k_z$ in the formula (21) is sufficient to be determined.

Figure 30:
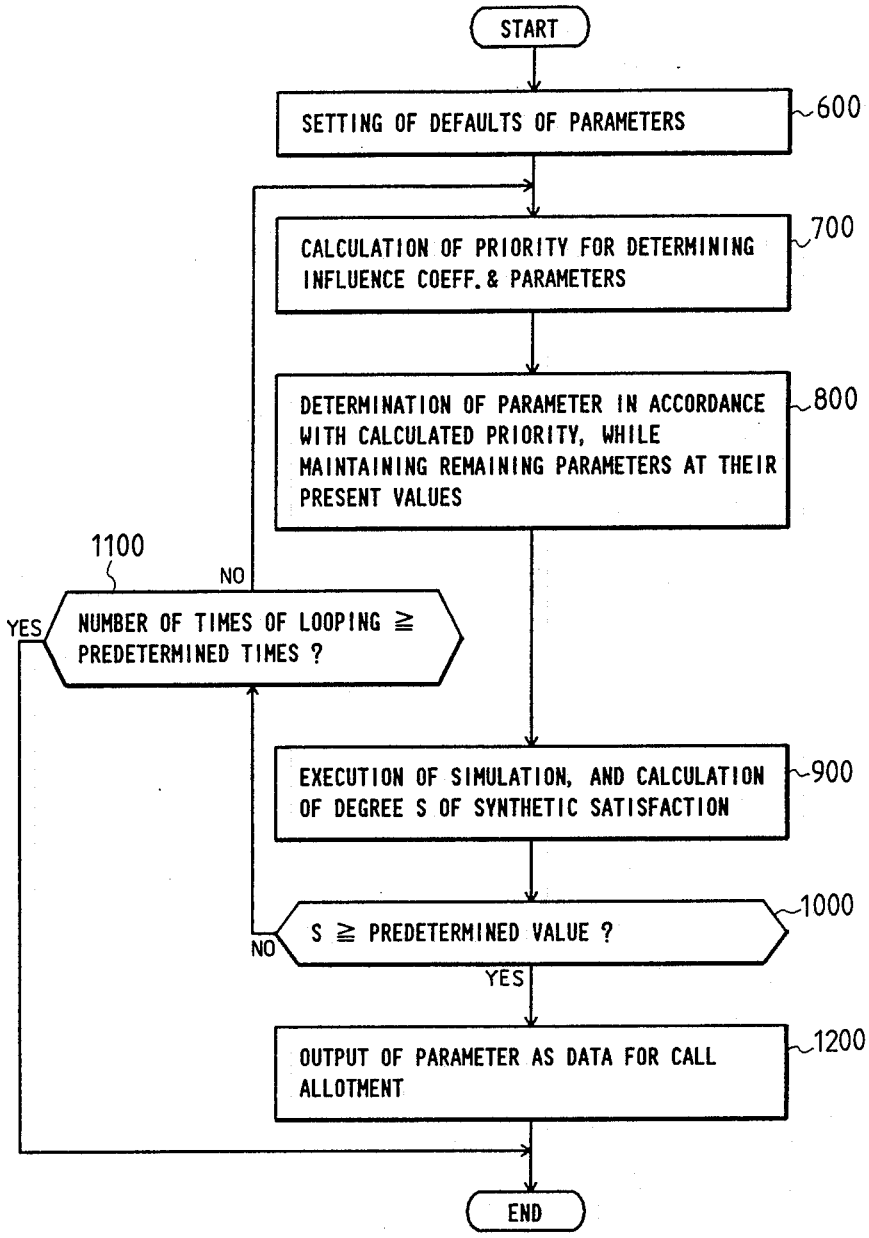
FIG. 30 is a flow chart showing the processing operation of determining the various control parameters.

A processing method for determining the control parameters $k_p$, $k_L$, $k_z$ will be explained, referring to FIG. 30 showing a flow chart thereof. After start of the processing operation of this flow, defaults of the control parameters are at first set at step 600. Then, at step 700, influence coefficients and priorities are calculated.

An influence coefficient as mentioned above is a coefficient indicative of the degree of influence of a control parameter on a corresponding control target, and a priority as mentioned above is one used to decide the order of determination of the control parameters.

Figure 31:
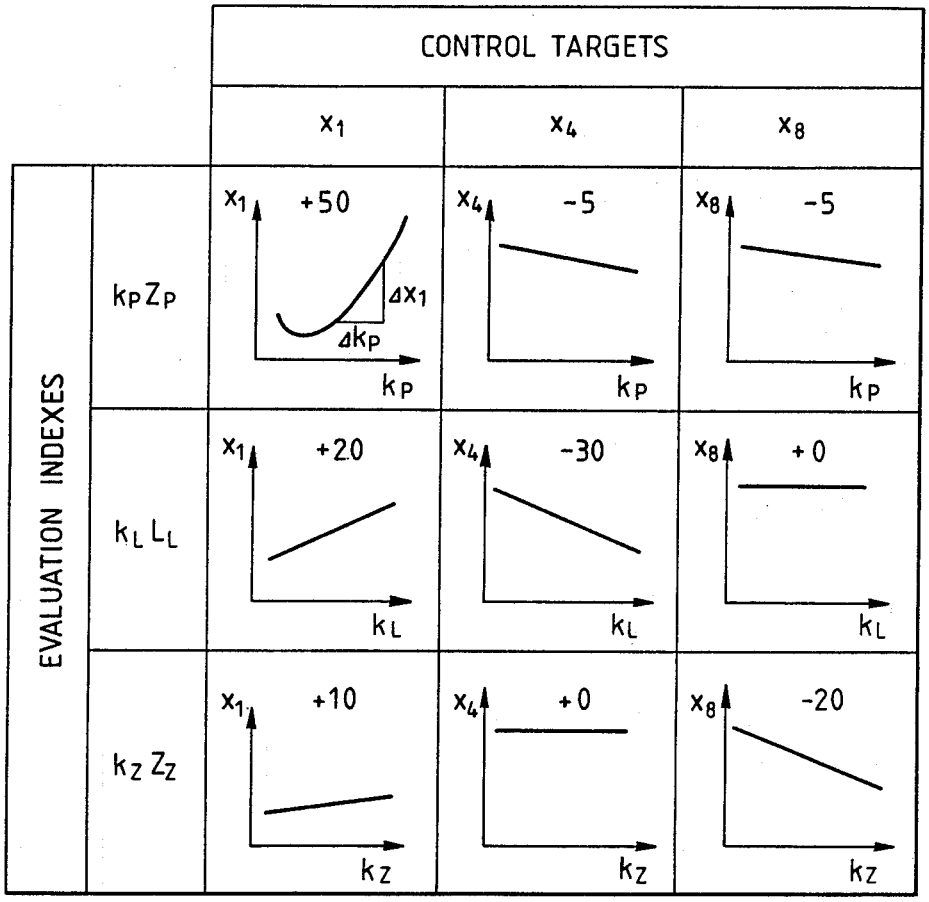
FIG. 31 is a table, in which there is shown an example of influence coefficients used in the processing operation, as shown in FIG. 30, for the determination of the control parameters.

In FIG. 31, there is shown an example of the influence coefficients $Q_{kx}$ of the control parameters $k_p$, $k_L$, $k_z$ on the respective control targets $x_1$, $x_4$, $x_8$ obtained in accordance with the following formula:

$$Q_{kx} = \frac{\Delta x}{\Delta k} \quad (24)$$

wherein $\Delta x$ and $\Delta k$ denote the increment or decrement of the control targets $x_1$, $x_4$, $x_8$ and the control parameters $k_p$, $k_L$, $k_z$, although they are represented in the general form. The thus obtained influence coefficients are written in the table of FIG. 31. The influence coefficients have a sign. The plus sign means the increment and the minus sign means the decrement. If the absolute value thereof is large, the degree of influence of the control parameters $k_p$, $k_L$, $k_z$ on the control targets $x_1$, $x_4$, $x_8$ is large.

Further, FIGS. 32*a* and 32*b* show examples of priorities for deciding the order of determination of the control parameters, which are obtained on the basis of the importance $g_w$ of the control targets determined in response to the feeling targets. In the fig., the total priority $K_i$ is expressed by the following formula:

$$K_u = \Sigma |Q_{k_u x_w} \cdot g_w| \quad (25)$$

wherein u = P, L, Z and w = 1, 4, 8.

FIG. 32*a* shows the case 1 where the importances $g_1$, $g_4$ and $g_8$ are set at 0.6, 0.3 and 0.1, respectively. In the case 1, the control item of the waiting time is regarded as being very important. FIG. 32*b* shows the case 2 where the importances $g_1$, $g_4$ and $g_8$ are set at 0.3, 0.6 and 0.1, respectively, and the cage-load factor is regarded as the important control item.

In the case 1 of FIG. 32*a*, the total priorities $K_p$, $K_L$, and $K_z$ of the control parameters are 33, 21 and 8, respectively. Therefore, the determination of the control parameters is carried out in the order of $k_p$, $k_L$, and $k_z$. On the other hand, in the case 2 of FIG. 32*b*, the total priorities $K_p$, $K_L$, and $K_z$ of the control parameters are 13, 22 and 4, respectively. Therefore, the order of the determination of the control parameters becomes the order of $k_L$, $k_p$ and $k_z$. In this manner, the control parameters are determined in the order of the priorities. Therefore, the control parameters can be determined by the relatively small number of times of simulation.

Returning to the flow chart of FIG. 30, at step 800, the control parameters are determined in the thus decided order. Further, when the determination of one of the control parameters is carried out, the remaining control parameters are maintained at respective values thereof. After one of the control parameters is determined, at step 900, the simulation is carried out with the determined control parameter and the degree S(%) of the synthetic satisfaction is calculated on the simulation result.

The synthetic satisfaction S is expressed by the following formula:

$$S = 100\Sigma\left\{\left(1.0 - \frac{|x_w - \bar{x}_w|}{x_w}\right)\cdot g_w\right\} \quad (26)$$

$$w = 1, 4, 8$$

wherein $x_w$ denotes a set value of the control target and $\bar{x}_w$ denotes a value obtained as the result of the statistical processing of the simulation data. According to the formula (26), 100 points are a perfect score of the synthetic satisfactions.

At step 1000, it is discriminated whether or not the calculated synthetic satisfaction S exceeds a predetermined value. When the calculated synthetic satisfaction S is smaller than the predetermined value, the processing operation returns to step 700 to constitute a closed loop. In a returning path from step 1000 to step 700, however, there is provided step 1100, at which it is discriminated whether or not the number of repetition times of the above described loop operation exceeds a predetermined value. If the number of repetition times of the loop operation does not exceeds the predetermined value, the processing operation returns to step 700 and the same operation as described above is repeated. Otherwise, the processing operation ends.

If it is discriminated at step 1000 that the predetermined synthetic satisfaction is achieved, the value determined at step 800 is outputted at step 1200 and the processing operation of determining the one parameter ends. The same operation as described above is repeated until all the control parameters are finally determined.

If the control parameters are obtained by the simulation method as mentioned above every time when it is necessary, the processing is much time-consuming. Therefore, a control parameter which has been once obtained is stored in a knowledge table, and the knowledge table can be retrieved in accordance with the necessities. If the necessary one is found, it is outputted, and if not, the control parameter acquiring processing operation as mentioned above is executed. According to this, it becomes possible to reduce the necessary volume of the knowledge table and to speed up the processing.

5 Advantage of the embodiments mentioned above

As described above, a group-control apparatus for an elevator system according to the present embodiment is roughly divided into two part in its function, i.e., an individualizing support part and a group-control part. An operator can determine a group-control method and various control parameters most suited for the manner of use of a building on the interactive basis by the aid of the individualizing support part.

Further, the retrieval and determination of an adaptive group-control method and control parameters are almost in charge of the individualizing support part, and only the results of processing in the individualizing support part are transmitted to the group-control part. Accordingly, the burden of a processor in charge of the group-control part can be made very small, compared with that of a processor for the individualizing support part, and therefore a relatively low cost processor can be employed for the group-control part.

Since there is provided a program registration function in the group-control part, the individualizing support part can be separated from the group-control part, once a group-control method and control parameters determined by the individualizing support part have been transmitted to the group-control part and stored therein. Therefore, an adaptive group-control method and control parameters in plural elevator systems can be individualized with a single apparatus for supporting the individualization, if the apparatus is made portable or if the apparatus is coupled with group-control apparatus of the respective elevator systems through telecommunication lines.

Moreover, the individualizing functions, the various kinds of algorithms of the control methods the control parameters and the rules for selecting or determining them are held as the knowledge data-base. Therefore, the correction and addition thereof can be easily made.

We claim:

1. A group-control method for an elevator system with plural elevator cages serving plural floors, in which when a hall call is generated, evaluation values of all of group-controlled cages with respect to the generated hall call are calculated by a predetermined evaluation function and the generated hall call is allotted to an adaptive cage, which has the most desired one of the calculated evaluation values, characterized in that there is established in accordance with a position of a cage such a first floor zone for the cage that a hall call generated within the zone is to be preferentially allotted to the cage, and that the evaluation function includes evaluation indexes of at least two control items of a waiting time and the first zone.

2. A group-control method as defined in claim 1, characterized in that the evaluation function further includes an evaluation index or indexes of a control item or items selected from among a riding time, a cage-load factor and a stop call.

3. A group-control method as defined in claim 2, characterized in that if a waiting time of a hall call already allotted to a cage exceeds a first predetermined threshold, then the evaluation values of all the remaining cages with respect to the hall call are calculated again by the evaluation function, and the hall call is changed to be allotted to an adaptive cage among the remaining cages, which has the most desired one of the calculated evaluation values.

4. A group-control method as defined in claim 3, characterized in that if a ratio of the predicted number of passengers of a reserved cage to the capacity of the cage exceeds a second threshold, then the evaluation values of all the remaining cages with respect to the hall call are calculated again by the evaluation function, and the hall call is changed to be allotted to a cage among the remaining cages, which has the smaller predicted number of passengers.

5. A group-control method as defined in claim 4, characterized in that even after a hall call generated at a certain floor has been once allotted t a cage, the evaluation values of all the cages with respect to the hall call are reviewed by the evaluation function at predetermined intervals, and that if an elapsed time from registration of the hall call to the present time does not exceed a third threshold, then the hall call is allotted to a cage evaluated as being most suited for serving the certain floor at the present time, and otherwise, a cage, which is evaluated as being most suited for serving the certain floor at a time point before the present time, is announced as a reserved cage to persons waiting at the certain floor.

6. A group-control method as defined in claim 5, characterized in that if the number of cages available for the service to a crowed floor is less than a fourth threshold, then it is increased.

7. A group-control method as defined in claim 6, characterized in that if a cage call floor of a cage agrees with a hall call floor of another cage and the cage is predicted to be a first-arriving cage, then a second floor zone is established for either the cage or the another cage between a present floor of the cage and the cage call floor, and that the evaluation function further includes an evaluation index of the second floor zone.

8. A group-control apparatus for an elevator system with plural elevator cages serving plural floors, comprising:

a first processor, provided with an input device and a display device, which executes the processing operation for determining a group-control method and various control parameters used in the group-control method, which are most suited for a manner of use of a building installed with the elevator system;

a second processor, coupled to said first processor, which executes the processing operation for group-control of the plural cages, in which evaluation values of all of group-controlled cages with respect to a generated hall call are calculated in accordance with an evaluation function defined by the group-control method and the control parameters determined by said first processor and the generated hall call is allotted to an adaptive cage, which has the most desired one among the calculated evaluation values; and third processor, provided for every elevator cage and all coupled to said second processor, for controlling the service operation of the respective elevator cages in accordance with a result of the group-control processing by said second processor, characterized in that the evaluation function includes evaluation indexes for control items of a waiting time taking account of an equal interval operation, a riding time, a cage-load factor, a rate of first-arriving cages and a stop call with control parameters functioning as weight coefficients for the respective control items, and said first processor determines the most suitable form of the evaluation function by selecting the control parameters and their values through the input device.

9. A group-control apparatus as defined in claim 8, characterized in that said first processor is programed to execute a processing operation for supporting the work for individualizing the group-control method to be most suited for the manner of use of the building, and the processing operation includes the following operations:

setting targets of multiple control items through the input device; and determining the most suitable group-control method and control parameters in accordance with predetermined rules, with which the targets of the multiple control items can be attained.

10. A group-control apparatus as defined in claim 9, characterized in that the processing operation further includes the following operations:

executing the simulation of the determined group-control method and control parameters by using traffic demand patterns provided in advance; and evaluating a simulation result to display an evaluation result on the display device and generating a control execution instruction when the evaluation result is approved.

11. A group-control apparatus as defined in claim 9, c h a r a c t e r i z e d in that the targets of the multiple control items are set by values in terms of the feeling of human, and the thus provided feeling targets are converted into control targets indicative of corresponding physical quantities by the setting operation.

12. A group-control apparatus as defined in claim 11, c h a r a c t e r i z e d in that the conversion is carried out by using individualizing functions representing the relation of a feeling target and a control target with respect to every control item, which are stored in advance as data-base in an appropriate storage of said first processor.

13. A group-control apparatus as defined in claim 11, c h a r a c t e r i z e d in that the determining operation of the group-control method and the control parameters executed by the first processor is composed of the following operation or function:

data-base of knowledge storing the previously provided relation of the group-control methods and control parameters to the control targets and the actual data, which is provided in the form of the traffic demand patters; and inferring a group-control method and control parameters, with which the set targets of the multiple control items can be attained, by retrieving the data-base of knowledge.

14. A group-control apparatus as defined in claim 13, c h a r a c t e r i z e d in that the relation of the control parameters to the control targets is provided in the order determined in view of a total priority of each control parameter, which is defined by an influence coefficient of the control parameter on the corresponding control target and an importance of the control target determined in response to the corresponding feeling target.

15. A group-control apparatus as defined in claim 14, c h a r a c t e r i z e d in that the control parameter is determined so as to make a synthetic satisfaction S larger than a predetermined value, in which the synthetic satisfaction S is defined as follows:

$$S = 100\Sigma\left\{\left(1.0 - \frac{|x_w - x_w|}{x_w}\right)\cdot g_w\right\}$$

wherein $x_w$ denotes a set value of a control target and $\bar{x}_w$ denotes a value obtained a the result of simulation.

16. A group-control apparatus as defined in claim 10, c h a r a c t e r i z e d in that the set control targets, the result of the simulation and the data obtained during the actual service operation are composed and displayed on the display device simultaneously.

17. A group-control apparatus as defined in claim 11, c h a r a c t e r i z e d in that said second processor has the program registration function, whereby the group-control method determined by said first processor is stored.

* * * * *